US011819910B2

(12) United States Patent
Chien

(10) Patent No.: US 11,819,910 B2
(45) Date of Patent: Nov. 21, 2023

(54) TOOL STEEL COMPOSITION FOR COMPONENT OF DIE-CASTING APPARATUS OR OF EXTRUSION PRESS

(71) Applicant: EXCO TECHNOLOGIES LIMITED, Markham (CA)

(72) Inventor: Lin Chun Chien, Oshawa (CA)

(73) Assignee: Exco Technologies Limited, Markham (CA)

( * ) Notice: Subject to any disclaimer, the term of this patent is extended or adjusted under 35 U.S.C. 154(b) by 707 days.

(21) Appl. No.: 15/725,402

(22) Filed: Oct. 5, 2017

(65) Prior Publication Data

US 2018/0099330 A1 Apr. 12, 2018

Related U.S. Application Data

(60) Provisional application No. 62/404,904, filed on Oct. 6, 2016.

(51) Int. Cl.

| | |
|---|---|
| ***C21D 9/00*** | (2006.01) |
| ***B22D 17/20*** | (2006.01) |
| ***C22C 38/02*** | (2006.01) |
| ***C21D 6/00*** | (2006.01) |
| ***C22C 38/00*** | (2006.01) |
| ***C22C 38/04*** | (2006.01) |
| ***C22C 38/42*** | (2006.01) |
| ***C22C 38/44*** | (2006.01) |
| ***C22C 38/46*** | (2006.01) |
| ***C22C 38/52*** | (2006.01) |

(52) U.S. Cl.

CPC ..... *B22D 17/2023* (2013.01); *C21D 6/004* (2013.01); *C21D 6/005* (2013.01); *C21D 9/00* (2013.01); *C21D 9/0068* (2013.01); *C22C 38/002* (2013.01); *C22C 38/02* (2013.01); *C22C 38/04* (2013.01); *C22C 38/42* (2013.01); *C22C 38/44* (2013.01); *C22C 38/46* (2013.01); *C22C 38/52* (2013.01)

(58) Field of Classification Search

CPC ..... C22C 38/02

See application file for complete search history.

(56) References Cited

U.S. PATENT DOCUMENTS

| | | | | |
|---|---|---|---|---|
| 5,195,572 | A | 3/1993 | Linden, Jr. et al. | |
| 5,270,124 | A * | 12/1993 | Saxby | B21B 27/00 428/683 |
| 5,322,111 | A | 6/1994 | Hansma | |
| 5,458,703 | A * | 10/1995 | Nakai | C21D 1/18 148/503 |
| 6,479,013 | B1 | 11/2002 | Sera et al. | |
| 9,492,855 | B2 * | 11/2016 | Heydasch | B21C 26/00 |

FOREIGN PATENT DOCUMENTS

| | | | |
|---|---|---|---|
| CN | 103014534 | | 4/2013 |
| CN | 106191694 | | 12/2016 |
| JP | 11131193 | A * | 5/1999 |
| JP | 2000144334 | A * | 5/2000 |
| JP | 2009293081 | | 12/2009 |

OTHER PUBLICATIONS

English machine translation of JP 2000-144334 A of Fujii (Year: 2000).*

International Search Report, Search Strategy and Written Opinion Issued in Respect of Counterpart PCT/CA2017/051189.

* cited by examiner

*Primary Examiner* — Jophy S. Koshy

(57) ABSTRACT

A tool steel composition for a component of a die-casting apparatus or of an extrusion press, comprises, in weight percentage: from about 0.35% to about 0.40% carbon (C); from about 0.32% to about 0.50% silicon (Si); from about 4.50% to about 5.50% chromium (Cr); from about 3.75% to about 4.75% molybdenum (Mo); from about 0.80% to about 1.00% vanadium (V); and iron (Fe).

21 Claims, 22 Drawing Sheets

TOOL STEEL COMPOSITION FOR COMPONENT OF DIE-CASTING APPARATUS OR OF EXTRUSION PRESS

CROSS-REFERENCE TO RELATED APPLICATION

This application claims the benefit of U.S. Provisional Application No. 62/404,904 to Chien filed on Oct. 6, 2016, the entire content of which is incorporated herein by reference.

FIELD

The subject disclosure relates generally to steel composition and in particular, to a tool steel composition for a component of a die-casting apparatus or of an extrusion press.

BACKGROUND

In the field of automotive manufacturing, structural components that historically have been fabricated of steel, such as engine cradles, are increasingly being replaced with aluminum alloy castings. Such castings are typically large, convoluted, and relatively thin, and are required to meet the high quality standards of automotive manufacturing. In order to meet these requirements, vacuum-assisted die-casting is typically used to produce such castings.

Vacuum-assisted die-casting machines comprise a piston, sometimes referred to as a "plunger", which is advanced through a piston bore of a shot sleeve to push a volume of liquid metal into a mold cavity. Vacuum is applied to the piston bore to assist the flow of the liquid metal therethrough. A replaceable wear ring is fitted onto the piston, and makes continuous contact with the inside of the piston bore along the full stroke of the piston for providing a seal for both the vacuum and liquid metal.

For example, FIG. 1 shows a portion of a prior art vacuum-assisted die-casting apparatus, which is generally indicated by reference numeral 20. Vacuum-assisted die-casting apparatus 20 comprises a piston that is moveable within a piston bore 28 defined within a shot sleeve 30 for pushing a volume of liquid metal (not shown) into a die-casting mold cavity (not shown) to form a casting. In the example shown, the piston is positioned at its starting position of the stroke, which is rearward of a port 34 through which the volume of liquid metal is introduced into the piston bore 28.

The piston comprises a piston tip 40 mounted on a forward end of a piston stem (not shown). The piston tip 40 has a front face 42 that is configured to contact the volume of liquid metal introduced into the piston bore 28 via port 34. The piston tip 40 has a wear ring 44 disposed on an outer surface thereof.

In operation, at the beginning of a stroke cycle, the piston is positioned at its starting position in the piston bore 28, and a volume of liquid metal is introduced into the piston bore 28 forward of the piston tip 40 via port 34. The piston is then moved forward through the piston bore 28 to push the volume of liquid metal into the mold cavity for forming a metal casting, and is then moved rearward to its starting position to complete the stroke cycle. During this movement, the wear ring 44 disposed on the piston tip 40 continuously contacts the inner surface 48 of the piston bore 28, and provides a liquid metal seal for preventing liquid metal from passing between the piston tip 40 and the inner surface 48 of the piston bore 28. The wear ring 44 also provides a vacuum seal for maintaining vacuum (that is, a low pressure) within the forward volume of the piston bore 28. The cycle is repeated, as desired, to produce multiple metal castings.

Die-casting shot sleeves having improved wear resistance have been described. For example, U.S. Pat. No. 5,195,572 to Linden, Jr. et al. discloses a two-piece shot sleeve for use with a die casting machine including first and second cylindrical sleeve sections that are removably axially secured together. The sleeve sections are each open at both ends and include an interior passage for the flow of molten metal, and the second sleeve section includes a pour hole for receiving molten metal into the interior passage.

U.S. Pat. No. 5,322,111 to Hansma discloses a lined shot sleeve for use in metal die casting. The lined shot sleeve comprises an elongated main body portion including a first continuous inner wall surface defining a receptacle bore axially extending between a first end and a second end of the main body portion. An elongated ceramic liner is adapted for secure placement within the receptacle bore, the liner including a second continuous inner wall surface defining a cylinder bore axially extending between a first end and a second end of the liner and an exterior wall surface adapted for frictional contact with the first continuous inner wall surface. The ceramic liner acts as a physical and thermal insulator to protect the first continuous inner wall surface of the main body portion from contact with the molten metal.

Tool steel compositions for casting apparatuses have also been described. For example, U.S. Pat. No. 6,479,013 to Sera et al. discloses casting non-ferrous metals such as aluminum, magnesium, or zinc alloys using casting components made from a tool steel comprising effective amounts of carbon, silicon, manganese, chromium, molybdenum, and vanadium, optional amounts of cobalt, and an increased level of molybdenum. Using the tool steel as a casting component, particularly as a mold, provides improvements in corrosion resistance, oxidation resistance, softening resistance, degradation resistance and deformation resistance.

Improvements are generally desired. It is an object at least to provide a novel tool steel composition for a component of a die-casting apparatus or of an extrusion press.

SUMMARY

Accordingly, in one aspect there is provided a tool steel composition for a component of a die-casting apparatus or of an extrusion press, the tool steel composition comprising, in weight percentage: from about 0.35% to about 0.40% carbon (C); from about 0.32% to about 0.50% silicon (Si); from about 4.50% to about 5.50% chromium (Cr); from about 3.75% to about 4.75% molybdenum (Mo); from about 0.80% to about 1.00% vanadium (V); and iron (Fe).

The composition may further comprise, in weight percentage: from about 0.36% to about 0.39% carbon (C). The composition may further comprise, in weight percentage: from about 0.37% to about 0.39% carbon (C). The composition may further comprise, in weight percentage, about 0.38% carbon (C).

The composition may further comprise, in weight percentage: from about 0.32% to about 0.45% silicon (Si). The composition may further comprise, in weight percentage: from about 0.32% to about 0.40% silicon (Si). The composition may further comprise, in weight percentage, about 0.34% silicon (Si).

The composition may further comprise, in weight percentage: from about 4.90% to about 5.10% chromium (Cr).

The composition may further comprise, in weight percentage: from about 4.95% to about 5.05% chromium (Cr). The composition may further comprise, in weight percentage, about 5.03% chromium (Cr).

The composition may further comprise, in weight percentage: from about 3.80% to about 4.50% molybdenum (Mo). The composition may further comprise, in weight percentage: from about 3.85% to about 4.25% molybdenum (Mo). The composition may further comprise, in weight percentage, about 4.18% molybdenum (Mo).

The composition may further comprise, in weight percentage: from about 0.85% to about 0.98% vanadium (V). The composition may further comprise, in weight percentage: from about 0.90% to about 0.96% vanadium (V). The composition may further comprise, in weight percentage, about 0.94% vanadium (V).

The composition may further comprise, in weight percentage, one or more of: from about 0.40% to about 0.50% manganese (Mn); from 0% to about 0.05% phosphorus (P); from about 0.06% to about 0.12% nickel (Ni); from about 0.005% to about 0.015% cobalt (Co); from about 0.05% to about 0.10% copper (Cu); and from about 0.09% to about 0.14% tungsten (W).

In one embodiment, there is provided a method of preparing a tool steel, the method comprising: subjecting a steel having the composition described above to a heat treatment, the heat treatment comprising: a hardening heat treatment, comprising heating the tool steel to one or more temperatures from about 850° C. to about 1125° C. for a total time of from about 1 hour to about 25 hours; and a tempering heat treatment, comprising heating the hardened tool steel to one or more temperatures from about 375° C. to about 675° C. for a total time of from about 1 hour to about 25 hours.

The hardening heat treatment may comprise: heating the steel to a first temperature of from about 800° C. to about 900° C., and holding the steel at the first temperature for at least 30 mins; and heating the steel to a second temperature of from about 950° C. to about 1150° C., and holding the steel at the second temperature for at least 30 mins.

The tempering heat treatment may comprise: subjecting the steel to at least one tempering cycle comprising: heating the steel to a temperature of from about 400° C. to about 600° C., and holding the steel at the temperature for at least 60 mins. The at least one tempering cycle may comprise a plurality of tempering cycles.

In another embodiment, there is provided a shot sleeve for a die-casting apparatus, the shot sleeve having a piston bore, the shot sleeve comprising: an elongate body having an axial bore; and a sleeve liner formed on a surface of the axial bore, the sleeve liner defining a surface of the piston bore, at least one of the body and the sleeve liner being fabricated of a tool steel having the composition described above.

The shot sleeve may further comprise a sleeve insert accommodated in the axial bore adjacent the sleeve liner, the sleeve insert defining an additional surface of the piston bore. The sleeve insert may be fabricated of the tool steel.

The sleeve liner may comprise a nitride surface layer defining the surface of the piston bore.

The sleeve liner may be integrally formed on the surface of the axial bore. The sleeve liner may be a welded layer.

The shot sleeve may further comprise: a sleeve insert accommodated in the axial bore adjacent the sleeve liner, the sleeve insert defining an additional surface of the piston bore. The axial bore may comprise a first axial bore segment and a second axial bore segment, the first axial bore segment accommodating the sleeve insert, and the sleeve liner being formed on the surface of the second axial bore segment. The body may comprise a port through which a volume of liquid metal is introduced into the piston bore, the sleeve insert having an aperture aligned with the port. The sleeve insert may comprise an axial cut configured to allow the sleeve insert to be circumferentially compressed. The sleeve insert may comprise a nitride surface layer defining the additional surface of the piston bore.

In another embodiment, there is provided a dummy block for a metal extrusion press comprising: a generally cylindrical base having a forward surface and an outwardly extending circumferential flange; an expandable collar coupled to the base, the collar having an inwardly extending circumferential rib abutting the circumferential flange; a collar support coupled to the base and abutting the collar; and a moveable plunger coupled to the base and accommodated by the collar, the plunger having a rear surface configured to abut the forward surface of the base, at least one of the base, the collar, the collar support and the plunger being fabricated of a tool steel having the composition described above.

The collar support and the base may define an annular groove accommodating the circumferential rib.

The circumferential rib may have a forward rib surface abutting a rear flange surface of the circumferential flange. The collar and the dummy block base may engage each other in an interlocking manner.

One or both of the collar and the collar support may be coupled to the base by shrink-fitting.

The circumferential flange may define a portion of the forward surface.

The plunger may comprise a convex face configured to abut a billet during use.

The dummy block may further comprise a rearward-extending stud or elongate projection for connecting the dummy block to an extrusion ram. The stud or elongate projection may comprise a central body and a plurality of lugs extending therefrom, each lug having a tapered rear portion blending the lug into the central body.

BRIEF DESCRIPTION OF THE DRAWINGS

Embodiments will now be described more fully with reference to the accompanying drawings in which.

DETAILED DESCRIPTION OF EMBODIMENTS

Figure 1:
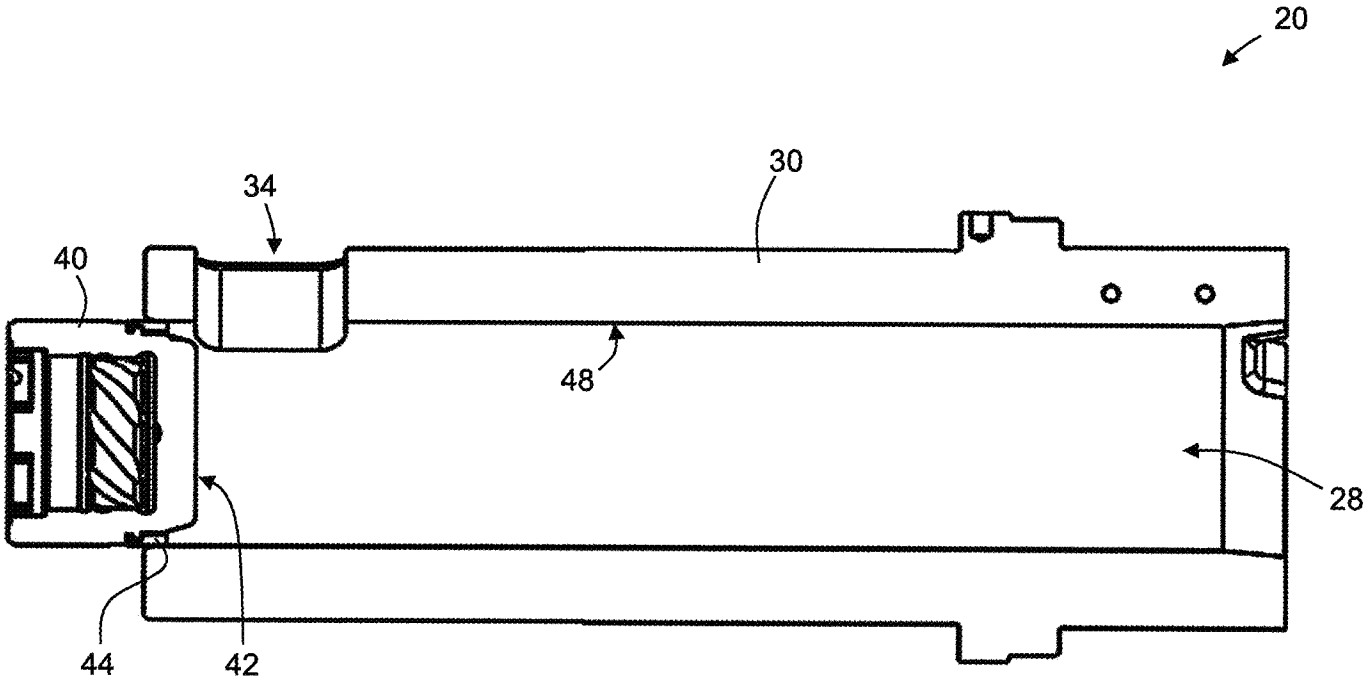
Figure 1 (PRIOR ART)
FIG. 1 is a side sectional view of a portion of a prior art die-casting apparatus, comprising a prior art shot sleeve and a piston tip of a piston.
Figure 2:
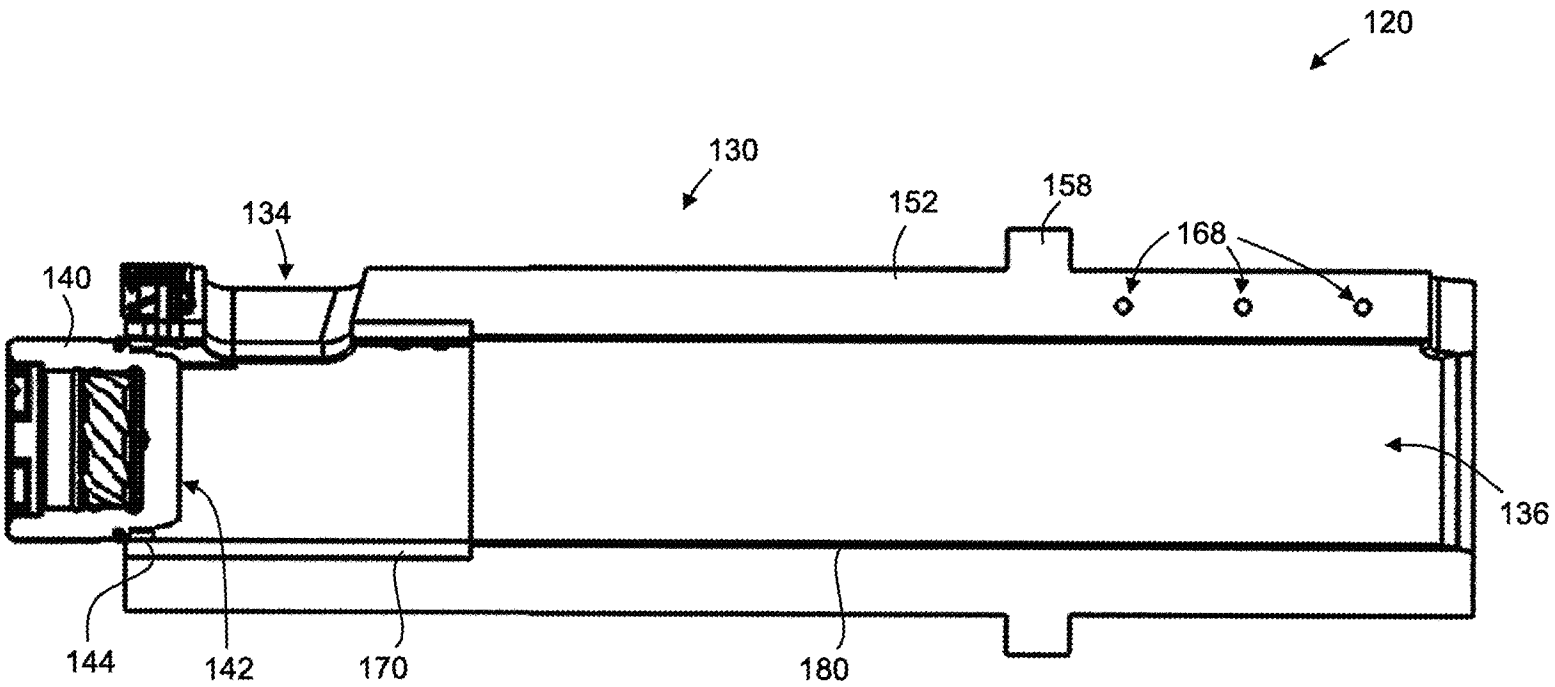
FIG. 2 is a side sectional view of a portion of a die-casting apparatus, comprising a shot sleeve and a piston tip of a piston.
Figure 3:
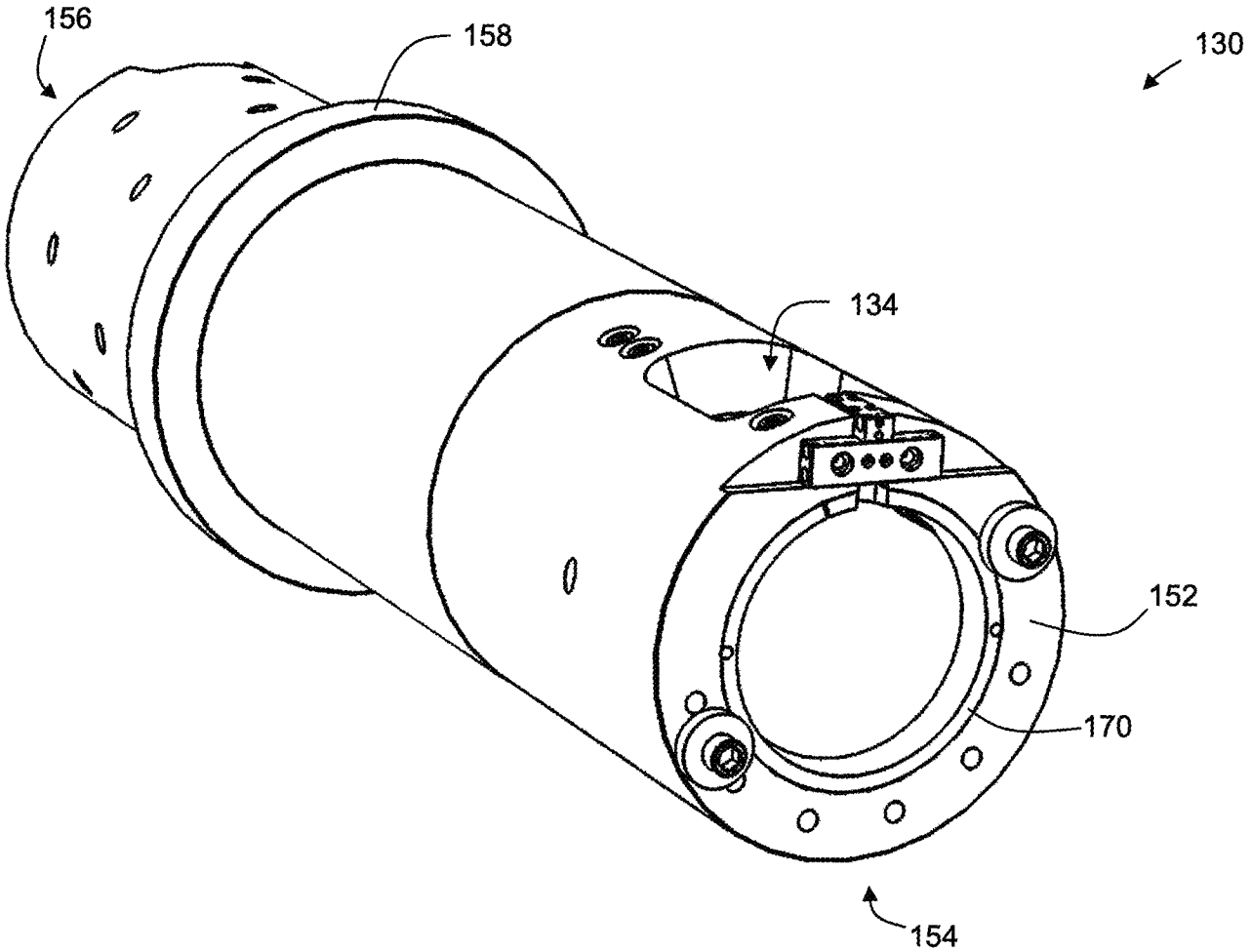
FIG. 3 is a perspective view of the shot sleeve of FIG. 2.
Figure 4:
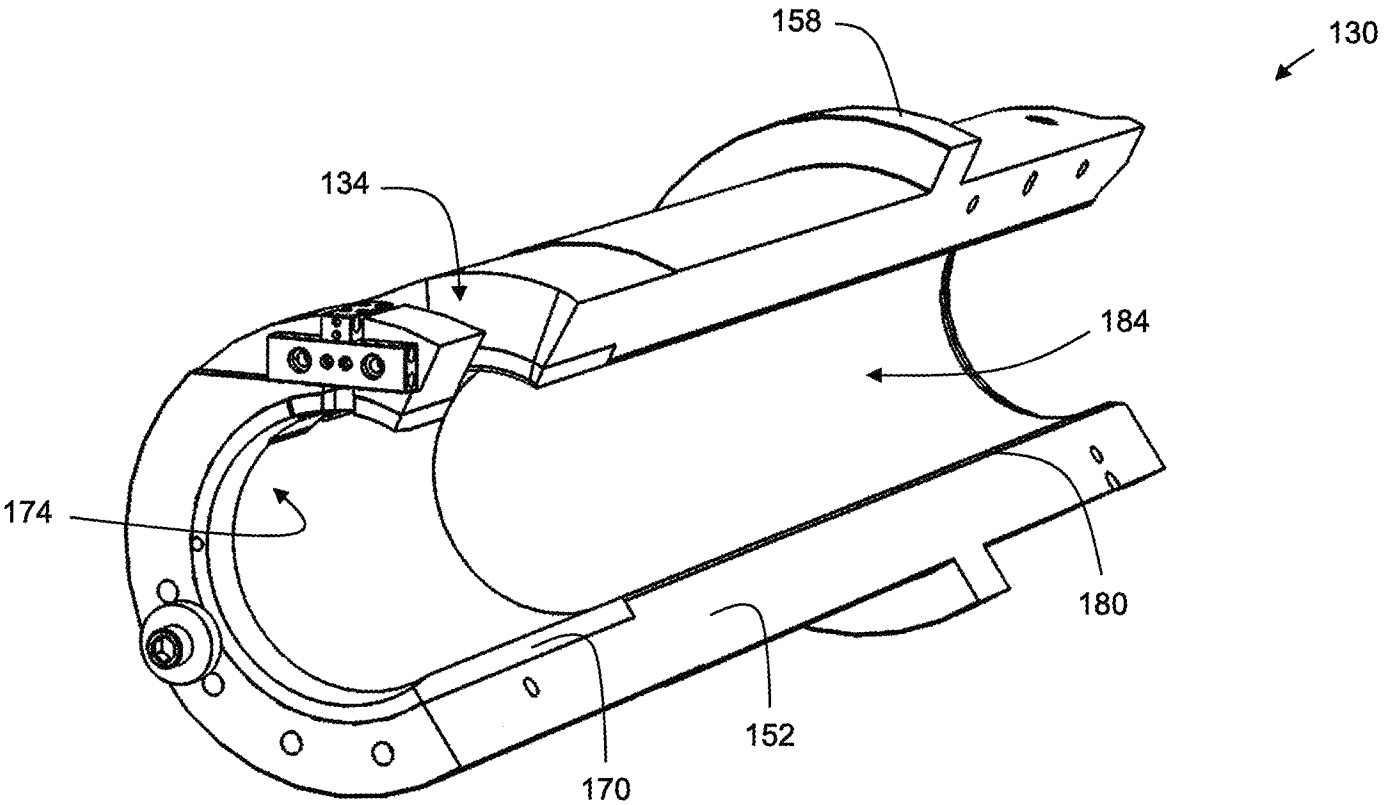
FIG. 4 is a perspective sectional view of the shot sleeve of FIG. 2.
Figure 5:
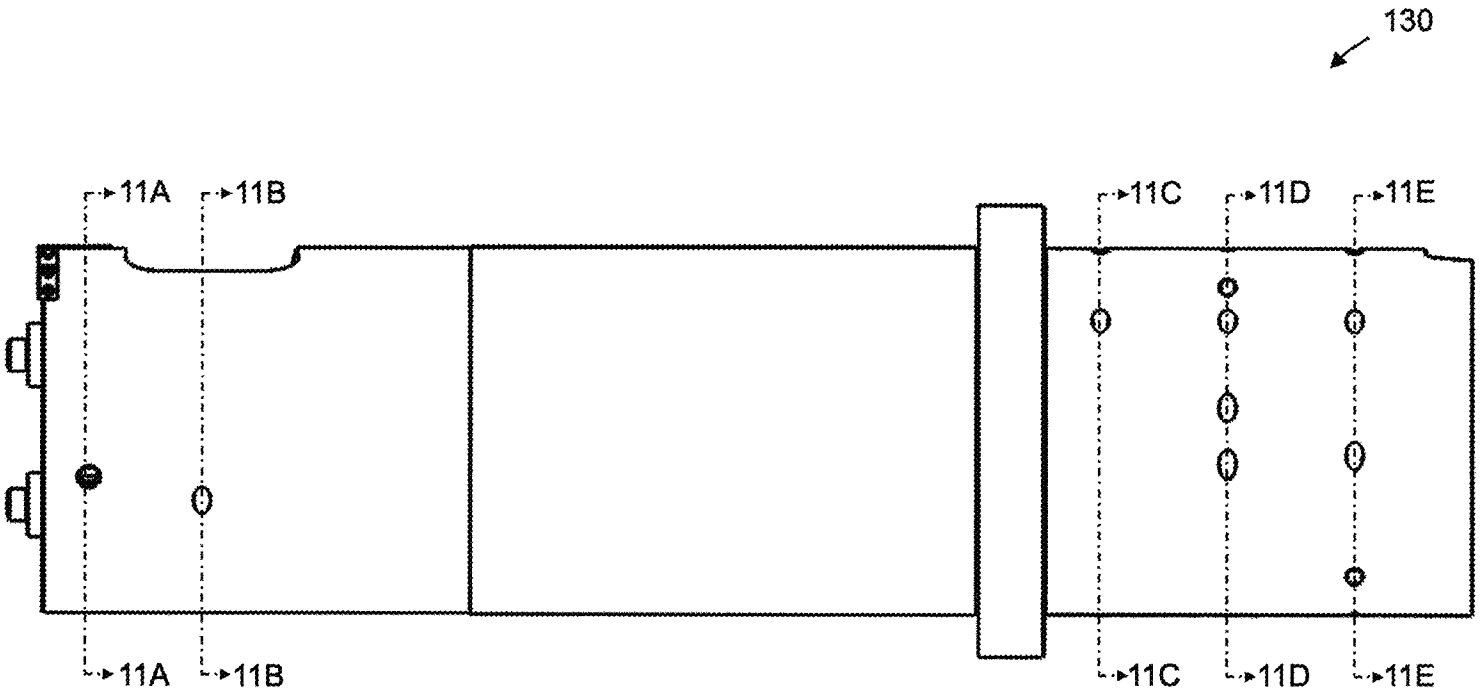
FIG. 5 is a side view of the shot sleeve of FIG. 2.
Figure 6:
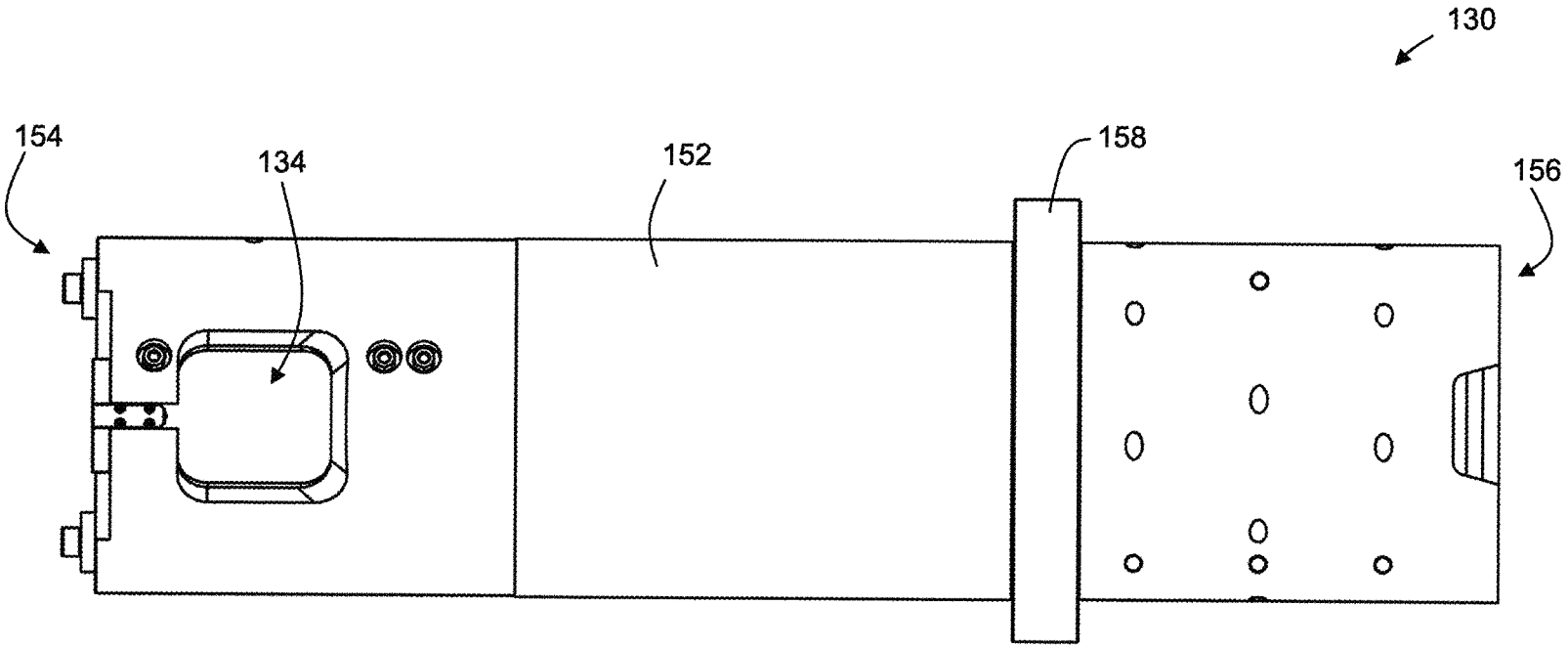
FIG. 6 is a top view of the shot sleeve of FIG. 2.
Figure 8:
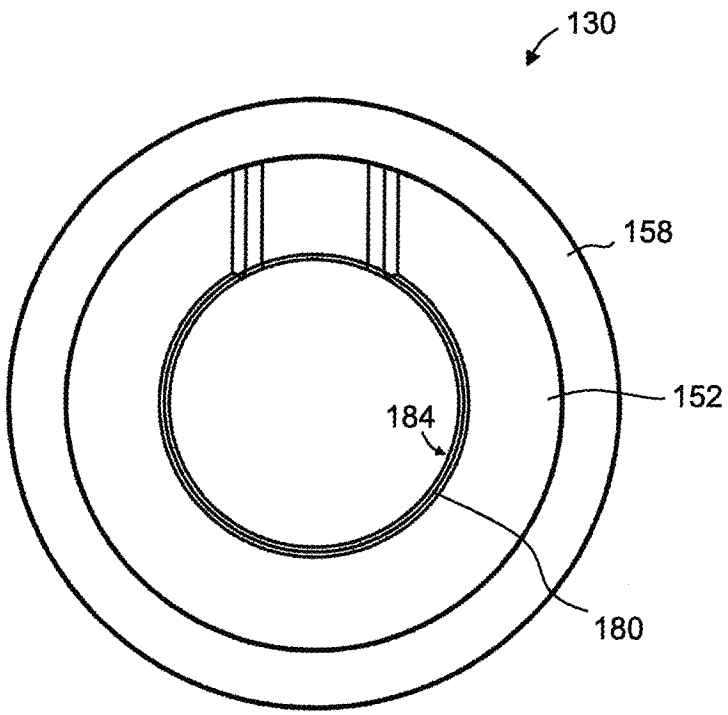
FIG. 8 is a die end view of the shot sleeve of FIG. 2.
Figure 7:
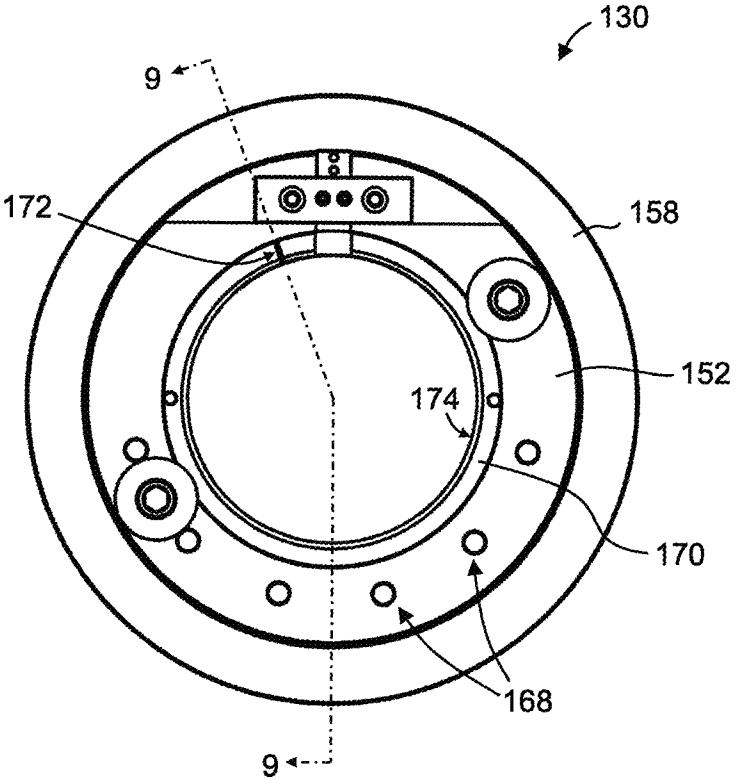
FIG. 7 is a pour end view of the shot sleeve of FIG. 2.
Figure 9:
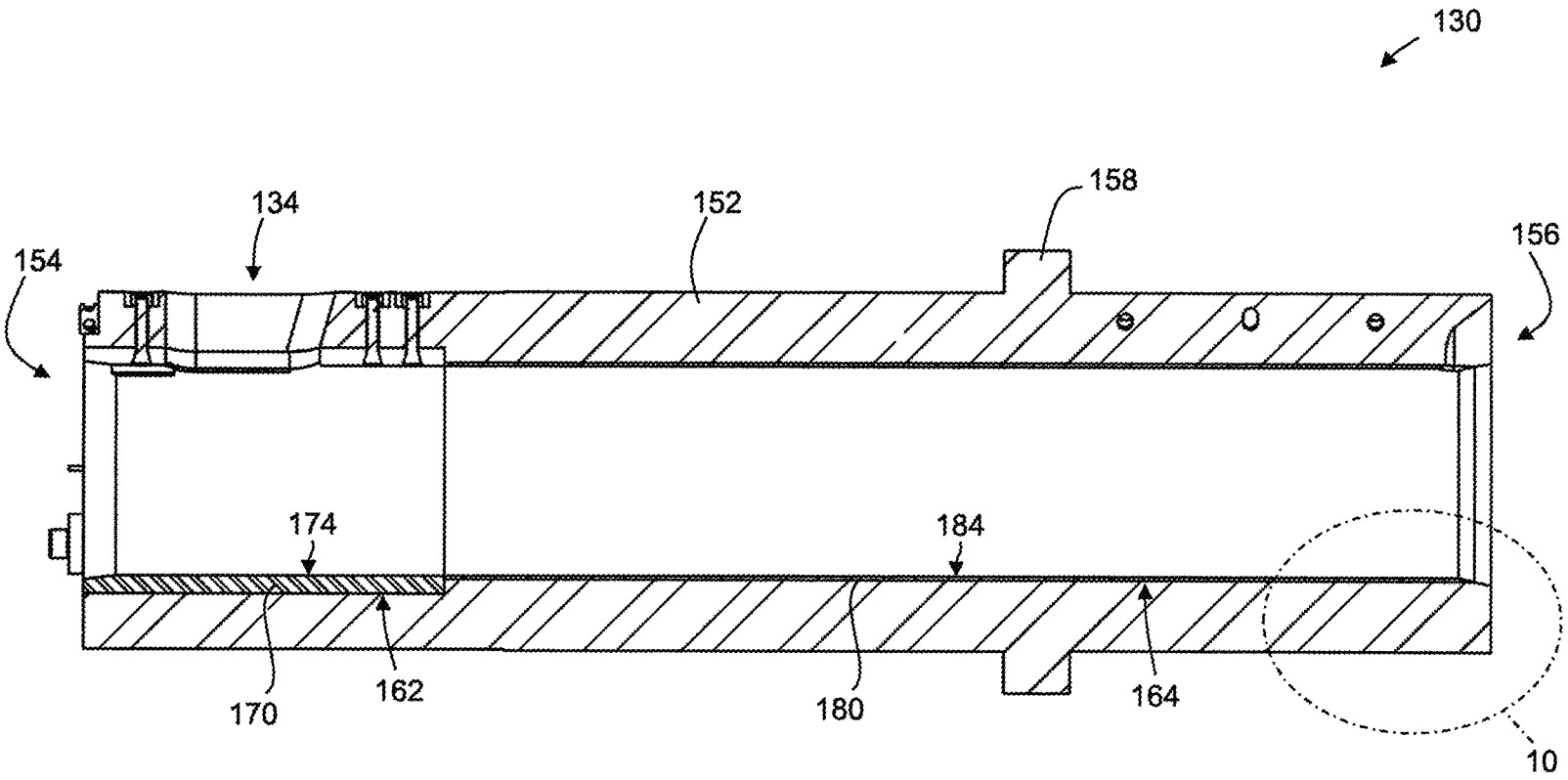
FIG. 9 is a sectional view of the shot sleeve of FIG. 7, taken along the indicated section line.
Figure 10:
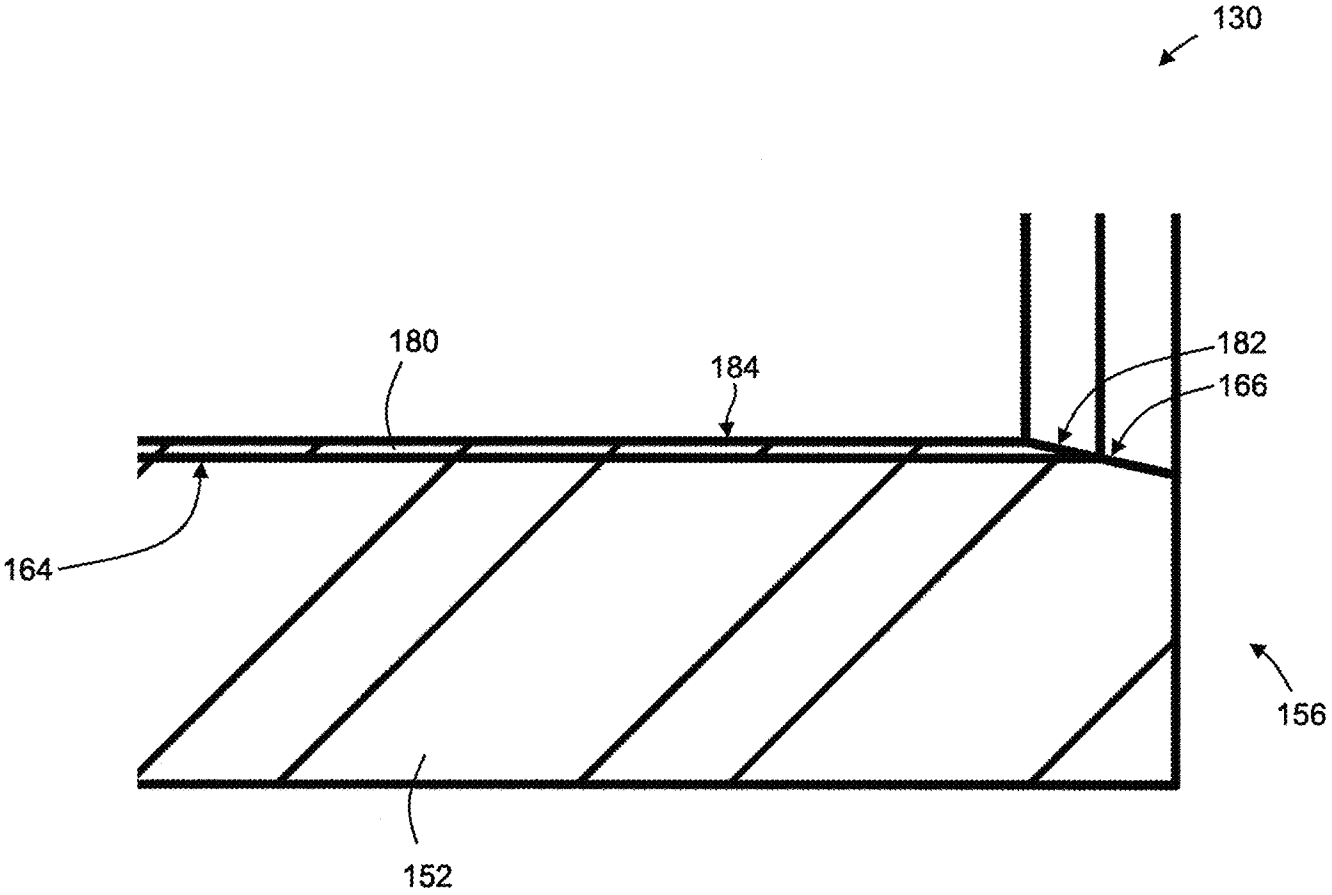
FIG. 10 is an enlarged fragmentary view of a portion of the shot sleeve of FIG. 9 identified by reference numeral 10.
Figure 11B:
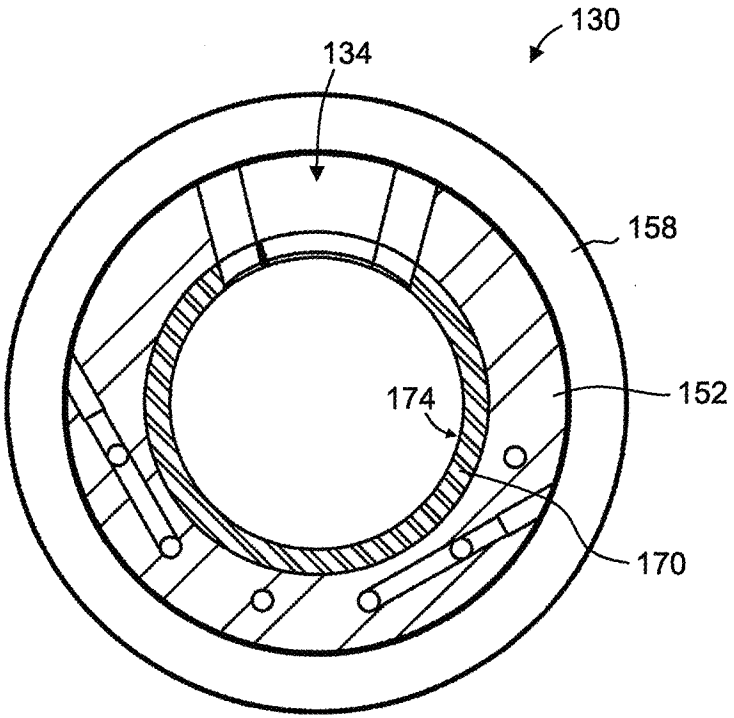
FIGS. 11A, 11B, 11C, 11D and 11E are sectional views of the shot sleeve of FIG. 5, taken along the indicated section lines.
Figure 11A:
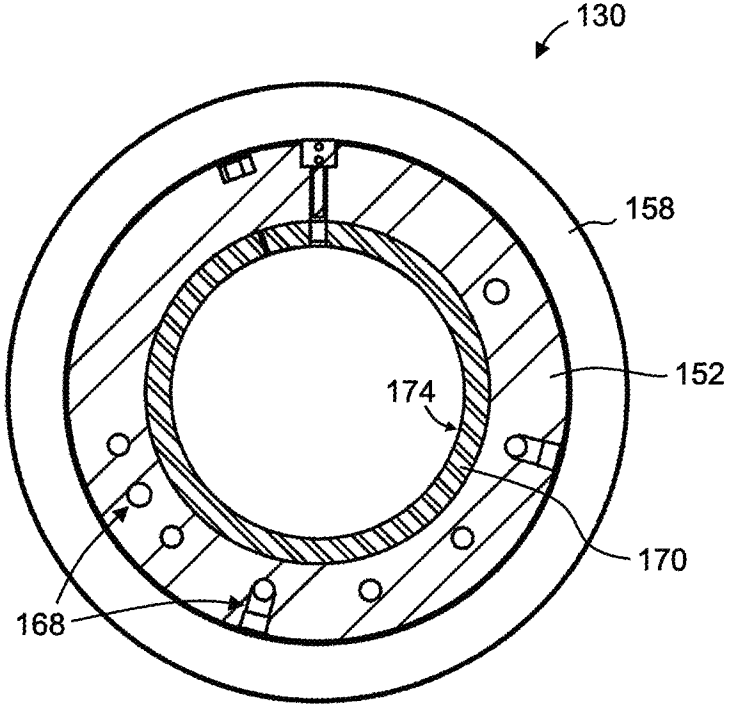
Figure 11D:
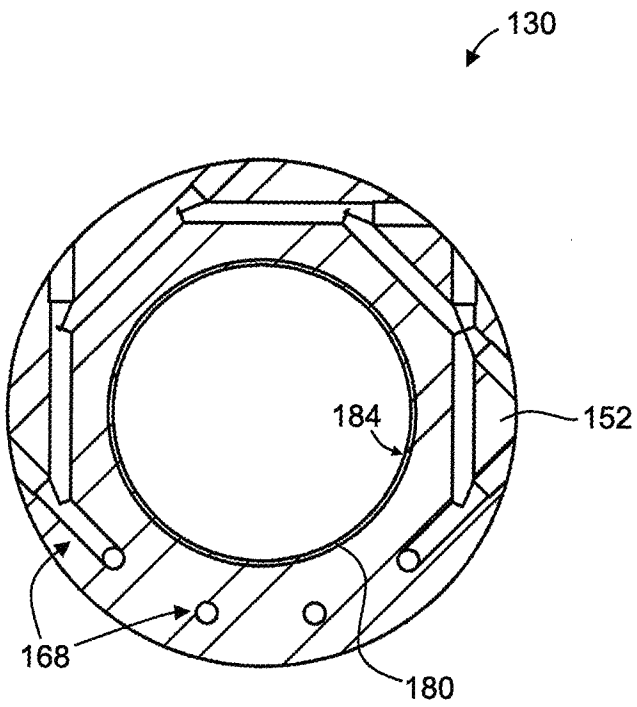
Figure 11C:
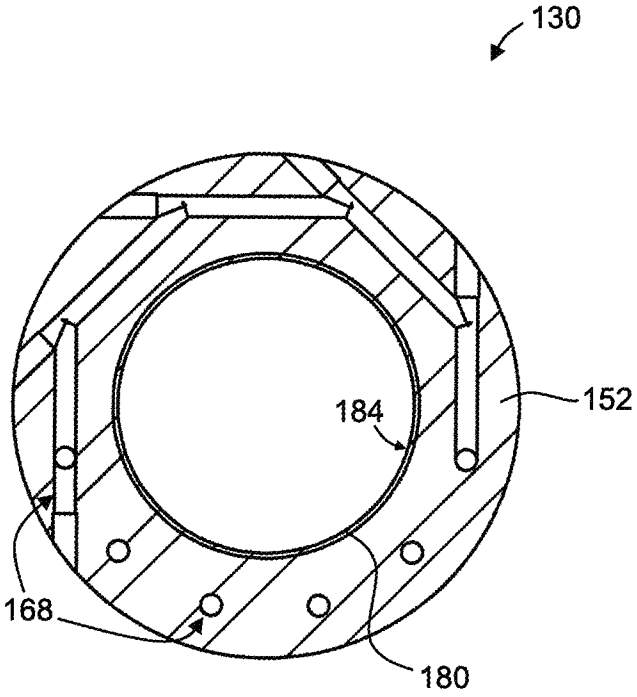
Figure 11E:
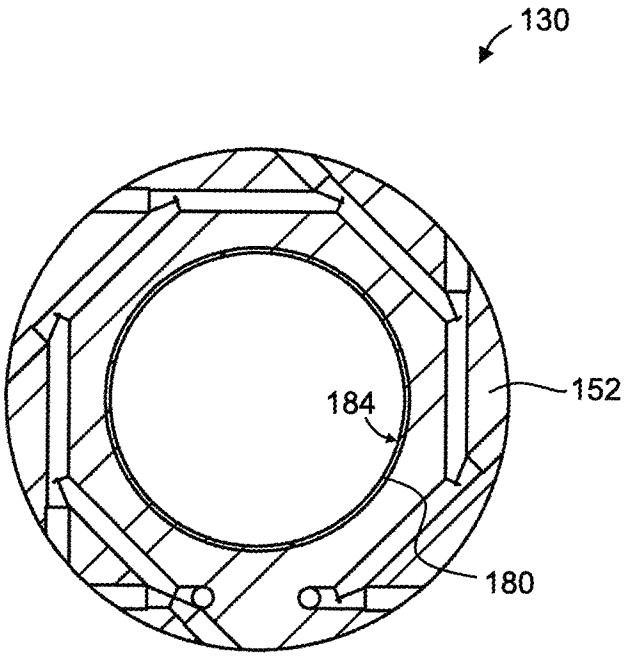

Turning now to FIG. 2 a portion of a vacuum-assisted die-casting apparatus is shown, and is generally indicated by reference numeral 120. Vacuum-assisted die-casting apparatus 120 comprises a piston that is moveable within a piston bore defined within a shot sleeve 130 for pushing a volume of liquid metal (not shown) into a die-casting mold cavity (not shown) to form a casting. The shot sleeve 130 comprises a port 134 through which the volume of liquid metal is introduced into the piston bore 136, and in the example shown, the piston is positioned at its starting position of the stroke, which is rearward of the port 134.

The piston comprises a piston tip 140 mounted on a forward end of a piston stem (not shown). The piston tip 140 has a front face 142 that is configured to contact the volume of liquid metal introduced into the piston bore 136 via port 134. The piston tip 140 has a wear ring 144 disposed on an outer surface thereof.

The shot sleeve 130 may be better seen in FIGS. 3 to 11E. The shot sleeve 130 comprises an elongate shot sleeve body 152 fabricated of a tool steel that has a higher ultimate tensile stress, a higher yield stress (YS), a higher elastic modulus at elevated temperatures (namely, from about 400° C. to about 825° C.), and a higher wear resistance than conventional tools steels. In this embodiment, the tool steel has the following composition (expressed in weight percentage): from about 0.35% to about 0.40% carbon (C); from about 0.32% to about 0.50% silicon (Si); from about 0.40% to about 0.50% manganese (Mn); from 0% to about 0.05% phosphorus (P); from about 4.50% to about 5.50% chromium (Cr); from about 3.75% to about 4.75% molybdenum (Mo); from about 0.06% to about 0.12% nickel (Ni); from about 0.005% to about 0.015% cobalt (Co); from about 0.05% to about 0.10% copper (Cu); from about 0.09% to about 0.14% tungsten (W); and from about 0.80% to about 1.00% vanadium (V), the balance being generally constituted by iron (Fe), and inevitable impurities.

Body 152 has a pour end 154 and a die end 156, and an outwardly-extending circumferential flange 158 for enabling the shot sleeve 130 to be mechanically coupled to a die platen (not shown) or a machine platen (not shown) of the die-casting apparatus 20. The body 152 has an axial bore extending therethrough, and in this embodiment the axial bore comprises a first axial bore segment 162 and a second axial bore segment 164. The first axial bore segment 162 extends partially into the length of the body 152 from the pour end 154, and the second axial bore segment 164 extends partially into the length of the body 152 from the die end 156. The first and second axial bore segments 162 and 164 are axially aligned, and in the embodiment shown the first axial bore segment 162 has a larger diameter than the second axial bore segment 164. At the die end 156, the second axial bore segment 164 has a conical inner surface 166 that is inclined relative to the center axis the body 152. The body 152 also has a plurality of internal conduits 168 surrounding the first and second axial bore segments 162 and 164, which are configured to convey cooling fluid from a cooling fluid source (not shown) for cooling the shot sleeve 130 during operation. The cooling fluid may be water, oil, air, and the like.

The body 152 is fabricated by machining a stock quantity of the above-described tool steel (e.g. in block or rod form) to a desired shape, and then subjecting the machined block to heat treatment. In this embodiment, the machined block is subjected to a heat treatment under vacuum comprising i) a hardening heat treatment, followed by ii) a tempering heat treatment. The hardening heat treatment comprises holding the machined block at one or more hold temperatures from about 850° C. to about 1125° C., for a total time of from about 1 hour to about 25 hours. The tempering heat treatment comprises one or more hold temperatures from about 375° C. to about 675° C., for a total time of from about 1 hour to about 25 hours, with the body 152 being cooled to room temperature prior to heating to each hold temperature. Subjecting the machined block to the heat treatment yields the body 152.

The shot sleeve 130 further comprises a replaceable sleeve insert 170 accommodated within the first axial bore segment 162 of the body 152. In this embodiment the sleeve insert 170 is fabricated of hot worked DIN 1.2367 grade steel. The sleeve insert 170 has an axial cut 172 configured to allow the sleeve insert 170 to be circumferentially compressed during insertion into and removal from the body 152. The sleeve insert 170 also has an aperture aligned with the port 134. The sleeve insert 170 has a nitride surface layer 174 that is formed during a nitriding treatment prior to insertion of the sleeve insert 170 into the body 152. The nitride surface layer 174 has a thickness of from about 0.20 mm to about 0.25 mm. As will be understood, the nitride surface layer 174 has higher hardness and higher high-temperature (namely, from about 625° C. to about 825° C.) yield strength, and therefore greater high-temperature stability, than the interior bulk of the sleeve insert 170.

The shot sleeve 130 also comprises a sleeve liner 180 integrally formed on the surface of the second axial bore segment 164 of the body 152. In this embodiment the sleeve liner 180 is fabricated of DIN 1.2367 grade steel. The sleeve liner 180 is formed by welding a layer of steel onto the surface of the second axial bore segment 164 of the body 152, and then grinding and honing the welded steel layer to a desired thickness and a desired surface roughness. In this embodiment, the thickness of the ground and honed welded steel layer is about 1.5 mm, and the value of the root mean squared (RMS) surface roughness of the ground and honed welded steel layer is about 3, or less. The sleeve liner 180 also has a conical inner surface 182 at the die end 156 that is generally coplanar with the conical inner surface 166 of the body. The sleeve liner 180 has a nitride surface layer 184 that is formed during a nitriding treatment of the shot sleeve after the welded steel layer has been ground and honed. Similar to nitride surface layer 174, the nitride surface layer 184 has a thickness of from about 0.20 mm to about 0.25 mm. As will be understood, the nitride surface layer 184 has higher hardness and higher high-temperature (namely, from about 625° C. to about 825° C.) yield strength, and therefore greater high-temperature stability, than the interior bulk of the sleeve liner 180.

In use, during fabrication of the shot sleeve 130, the shot sleeve body is fabricated by machining the stock quantity of the tool steel having the above-described composition to the desired shape, and then subjecting the machined block to the heat treatment to yield the shot sleeve body 152. The body 152 is then heated to a preheat temperature to enable good weld adhesion, with the specific preheat temperature depending on the grade of steel to be used for the welded steel layer. In this embodiment, the preheat temperature is from about 300° C. to about 450° C. The layer of steel, which has a thickness of about 3.0 mm, is then welded onto the surface of the second axial bore segment 164 of the preheated shot sleeve body 152. The shot sleeve body 152 and the welded steel layer therein are then subjected to heat treatment to reduce residual stress generated during welding, with the specific time and temperature profile of the heat treatment depending on the grade of steel of the welded steel layer. In this embodiment, the heat treatment includes temperatures from about 300° C. to about 450° C. The welded steel layer is then ground to reduce its thickness to about 1.5 mm, and the shot sleeve is then conically bored at its die end 156 to form the conical inner surface 182. After grinding and conical boring, the welded steel layer is honed to a desired final dimension to reduce the RMS surface roughness value to about 3, or less, to yield the sleeve liner 180. The shot sleeve body 152 and sleeve liner 180 therein are then subjected to a nitriding treatment to form the nitride surface layer 184. During the nitriding treatment, the shot sleeve body 152 and sleeve liner 180 therein are subjected to a nitriding temperature in a nitriding atmosphere, and in this embodiment the nitriding temperature is from about 500° C. to about 550° C. The sleeve insert 170 is fabricated separately so as to have generally identical inner diameter and RMS surface roughness as the sleeve liner 180, and to have the nitride surface layer 174. The sleeve insert 170 is inserted into the first axial bore segment 162 of the body 152, and against the sleeve liner 180 in an abutting manner, so as to yield the shot sleeve 130. As will be understood, the sleeve insert 170 and the sleeve liner 180 define the surface of the piston bore 136 of the shot sleeve 130. More specifically, in this embodiment, the nitride surface layer 174 of the sleeve insert 170 and the nitride surface layer 184 of the sleeve liner 180 define the surface of the piston bore 136 of the shot sleeve 130.

In operation, at the beginning of a stroke cycle, the piston is positioned at its starting position in the piston bore 136, and a volume of liquid metal is introduced into the piston bore 136 forward of the piston tip 140 via port 134. The piston is then moved forward through the piston bore 136 to push the volume of liquid metal into the mold cavity for forming a metal casting, and is then moved rearward to its starting position to complete the stroke cycle. During this movement, the wear ring 144 disposed on the piston tip 140 continuously contacts the surface of the piston bore 136, and provides a liquid metal seal for preventing liquid metal from passing between the piston tip 140 and the inner surface 48 of the piston bore 28. The wear ring 144 also provides a vacuum seal for maintaining vacuum (that is, a low pressure) within the forward volume of the piston bore 136. The cycle is repeated, as desired, to produce multiple metal castings.

As will be appreciated, the high ultimate tensile stress, high yield stress, and high elastic modulus at elevated temperatures of the tool steel advantageously increase the strength of the shot sleeve body 152 at the elevated temperatures experienced during normal die-casting operations. These features advantageously enable the shot sleeve 130 to be more durable and to have a longer service life than conventional shot sleeves.

The composition of the tool steel is not limited to any specific, single composition. Preferably, the composition of the tool steel comprises from about 0.36% to about 0.39% C. More preferably, the composition of the tool steel comprises from about 0.37% to about 0.39% C, and most preferably about 0.38% C.

Preferably, the composition of the tool steel comprises from about 0.32% to about 0.45% Si. More preferably, the composition of the tool steel comprises from about 0.32% to about 0.40% Si, and most preferably about 0.34% Si.

Preferably, the composition of the tool steel comprises from about 4.90% to about 5.10% Cr. More preferably, the composition of the tool steel comprises from about 4.95% to about 5.05% Cr, and most preferably about 5.03% Cr.

Preferably, the composition of the tool steel comprises from about 3.80% to about 4.50% Mo. More preferably, the composition of the tool steel comprises from about 3.85% to about 4.25% Mo, and most preferably about 4.18% Mo.

Preferably, the composition of the tool steel comprises from about 0.85% to about 0.98% V. More preferably, the composition of the tool steel comprises from about 0.90% to about 0.96% V, and most preferably about 0.94% V.

Although in the embodiment described above, the shot sleeve body is fabricated of the tool steel and the sleeve insert 170 and the sleeve liner 180 are fabricated of hot worked DIN 1.2367 grade steel, in other embodiments, one or both of the sleeve insert and the sleeve liner may alternatively be fabricated of the tool steel.

Figure 12A:
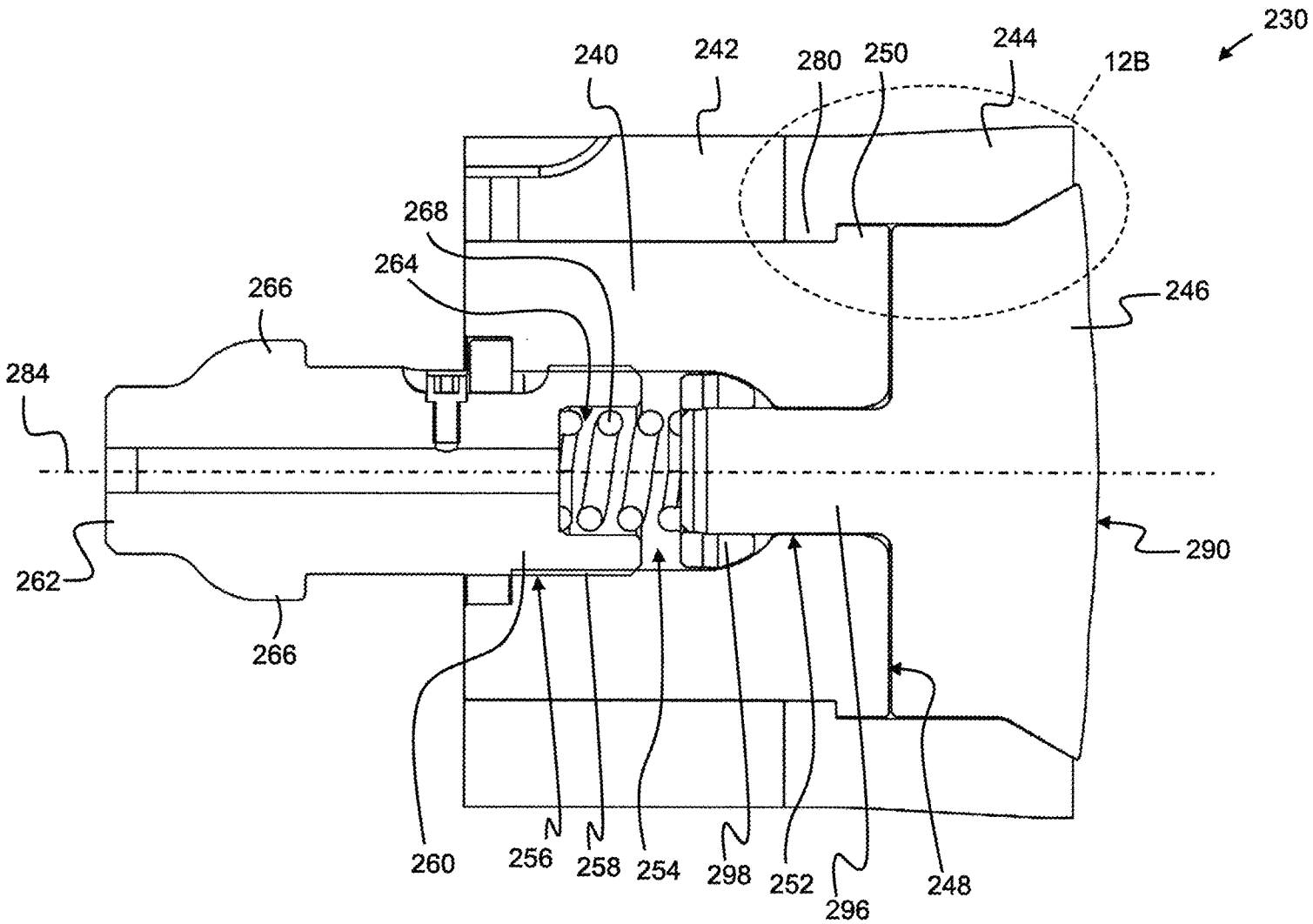
FIG. 12A is a side sectional view of a dummy block forming part of an extrusion press.
Figure 12B:
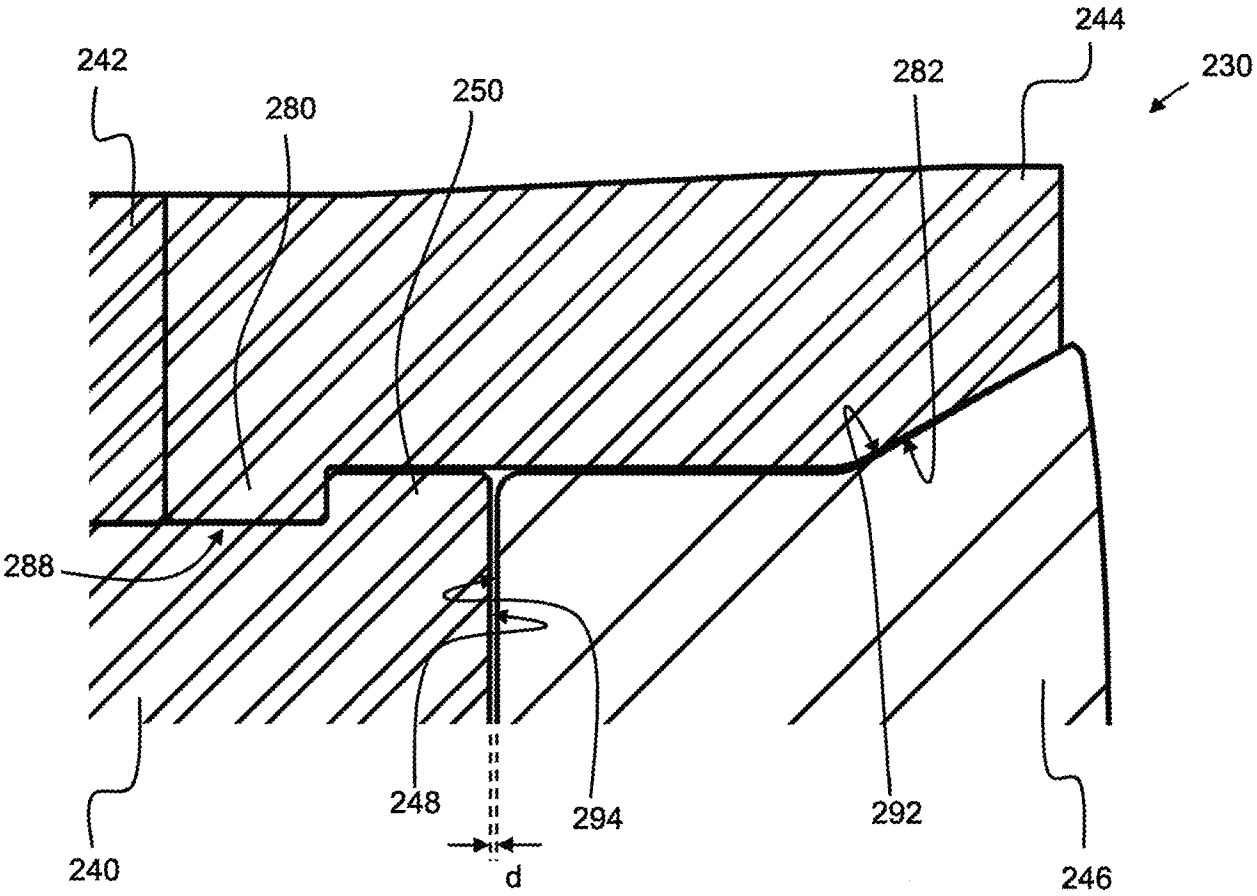
FIG. 12B is an enlarged fragmentary view of the dummy block of FIG. 12A identified by reference character 12B.
Figure 12C:
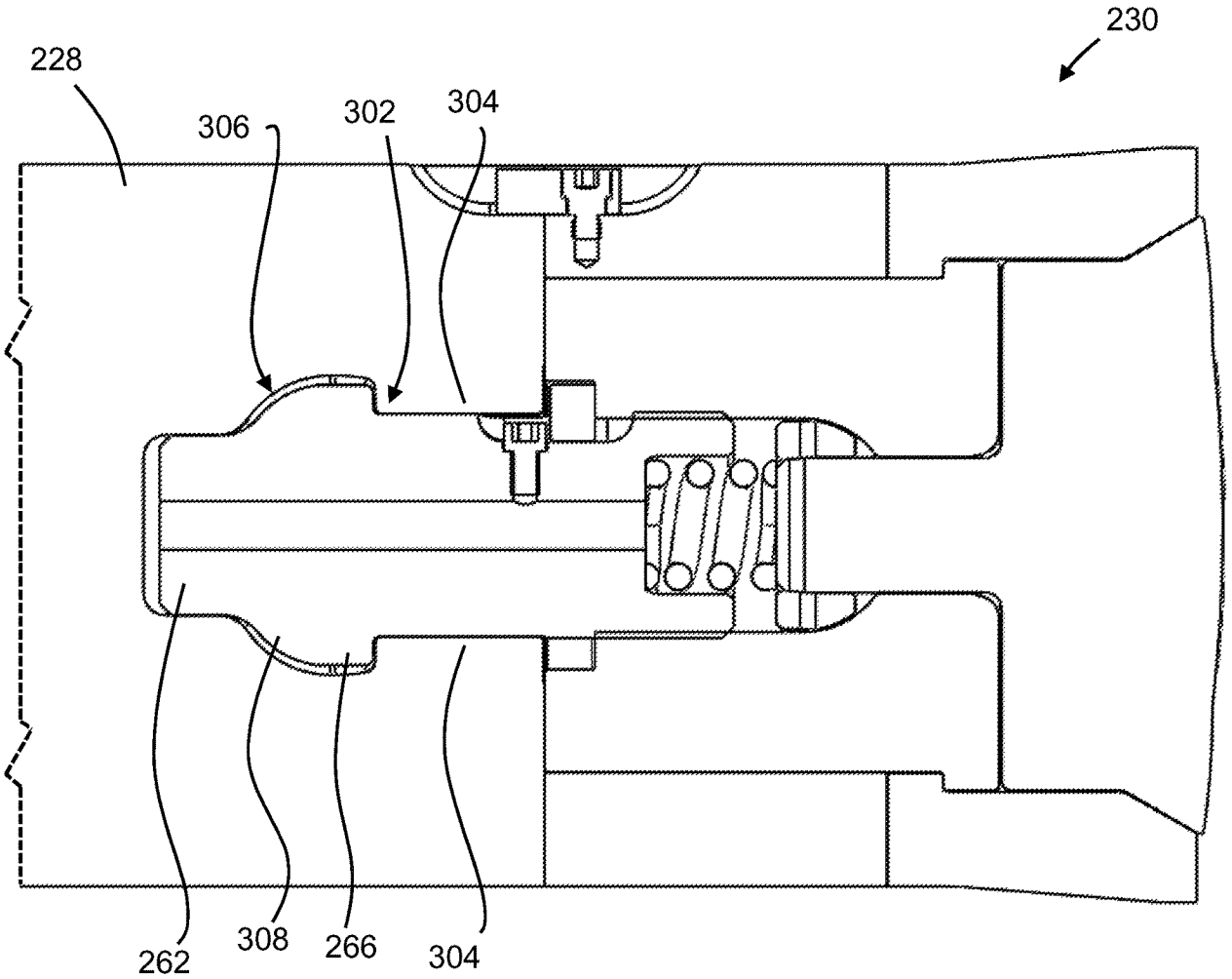
FIG. 12C is a side sectional view of the dummy block of FIG. 12A, and a portion of an extrusion ram forming part of the metal extrusion press.

The tool steel is not limited to use in components for a die-casting apparatus, and in other embodiments, the tool steel may be used in one or more components of a metal extrusion press. For example, a dummy block of an extrusion press for use in metal extrusion is shown in FIGS. 12A to 12C, the dummy block being generally indicated by reference numeral 230. Dummy block 230 comprises an inner dummy block base 240, an outer collar support 242 coupled to the dummy block base 240, a replaceable collar 244 coupled to the dummy block base 240 and seated against the collar support 242, and a moveable plunger 246 positioned forward of the dummy block base 240 and within the collar 244. The plunger 246 is configured to move rearwardly when the dummy block 230 abuts a billet (not shown) during use, which in turn causes the collar 244 to expand.

The dummy block base 240 comprises a generally cylindrical body having a planar forward surface 248. A circumferential flange 250 extends outwardly from the dummy block base 240 at its forward end, and defines a portion of the planar forward surface 248. The dummy block base 240 has a center bore 252 extending from the planar forward surface 248 to a central recess 254. The dummy block base 240 further comprises a plurality of threads 256 formed on an interior surface defining the central recess 254, and which are configured to engage complimentary outer threads 258 formed on an exterior surface of a stem 260 of a stud 262 or other elongate projection. The stem 260 has a central recess 264 for accommodating a spring 268 that is configured to provide a biasing force urging the plunger 246 away from the from the planar forward surface 248 of the dummy block base 240. The stud 262 or other elongate projection is mounted on a forward end of an extrusion ram 228, and comprises four (4) spaced-apart lugs 266 that are configured to abut corresponding lugs of the extrusion ram 228, as described below.

The collar 244 comprises a generally annular body, and is coupled to the dummy block base 240 by shrink-fitting. The collar 244 has an inwardly extending circumferential rib 280 that is configured to abut a rear surface of the circumferential flange 250, such that the collar 244 and the dummy block base 240 engage each other in an interlocking manner. The collar 244 also has a conical inner surface 282 that is inclined relative to the center axis 284 of the dummy block 230, and which defines a first angle with the center axis 284.

The collar support 242 comprises a generally annular body, and is coupled to the dummy block base 240 by shrink-fitting. The collar support 242 has a forward surface that abuts the collar 244, such that the collar 244 is seated against the collar support 242. In this manner, the circumferential rib 280 of the collar 244 is accommodated within an annular groove 288 defined between the collar support 242 and the dummy block base 240.

The plunger 246 has a convex forward face 290 that is configured to abut a billet. The plunger 246 also has a conical outer surface 292 adjacent the convex face 290. The conical outer surface 292 is inclined relative to the center axis 284 of the dummy block 230, such that the conical outer surface 292 defines a second angle with the center axis 284. The plunger also has a planar rear surface 294 that is configured to abut the forward surface 248 of the dummy block base 240. Extending rearwardly from the rear surface 294 is a post 296 that is shaped to extend through the center bore 252 and into the central recess 254 of the dummy block base 240. A connector 298 is fastened to a distal end of the post 296 within the central recess 254 for coupling the moveable plunger 246 to the dummy block base 240, and for providing a surface against which the spring 268 abuts. As shown in FIG. 12B, the plunger 246 is shaped such that the planar rear surface 294 and the planar forward surface 248 are spaced by a distance when the moveable plunger 246 is not depressed against the dummy block base 240.

The second angle defined by the conical outer surface 292 and the center axis 284 is slightly greater than the first angle defined by the conical inner surface 282 and the center axis 284, so as to ensure that the plunger 246 and the collar 242 do not become jammed during use. In the embodiment shown, the difference between the second angle and the first angle is about 1.5 degrees. As will be understood, if the angle of inclination of the conical outer surface 292 were the same as, or less than, the angle of inclination of the conical inner surface 282, these surfaces would jam as the plunger moves rearwardly into the collar 242 such that when the dummy block is removed from the container, the spring 268 would not have sufficient force to return the plunger 246 to its initial position.

A forward portion of an extrusion ram 228 is shown in FIG. 20C. Extrusion ram 228 comprises a central cavity 302 extending inwardly from its forward surface, and which is configured to matingly engage the stud 262 of the dummy block 230. The extrusion ram 228 has four (4) spaced-apart lugs 304 that project into the cavity 302, and that are configured to abut forward surfaces of the lugs 266 of the stud 262 when the dummy block 230 and stud 262 are rotated into position. The central cavity 302 has a partially concave rear surface 306 having a relatively large radius, which eliminates stress concentration points within the extrusion ram 228. Additionally, each lug 266 has a tapered rear portion 308 that blends shape of the lug 266 into the stud 262, which eliminates stress concentration points within the lug 266 and the stud 262.

One or more of the dummy block base 240, the outer collar support 242, the replaceable collar 244 coupled, the moveable plunger 246, and the extrusion ram 228 is fabricated of the same tool steel as that of the shot sleeve body 152 of shot sleeve 130, described above and with reference to FIGS. 3 to 11E. In this embodiment, each of the dummy block base 240, the outer collar support 242, the replaceable collar 244 and the moveable plunger 246 is fabricated of the tool steel.

As will be appreciated, the high ultimate tensile stress, high yield stress, high elastic modulus at elevated temperatures, and high wear resistance of the tool steel advantageously increase the strength of the dummy block base 240, the outer collar support 242, the replaceable collar 244 and the moveable plunger 246 at the elevated temperatures experienced during normal extrusion operations. These features advantageously enable the dummy block 230 to be more durable and to have a longer service life than conventional dummy blocks.

The following examples illustrate various applications of the above-described embodiments.

EXAMPLE 1

In this example, a shot sleeve body was fabricated of a tool steel having the composition shown in Table 1:

TABLE 1

| Element | Weight % |
|---|---|
| C | 0.38 |
| Si | 0.34 |
| Mn | 0.43 |
| P | 0.022 |
| S | <0.005 |
| Cr | 5.03 |
| Mo | 4.18 |
| Ni | 0.09 |
| Co | 0.01 |
| Cu | 0.07 |
| W | 0.12 |
| V | 0.94 |

The balance of the composition was mainly constituted by Fe (iron), and inevitable impurities.

The composition was measured by optical emission spectroscopy (OES) in accordance with ASTM E352-93 (2006).

EXAMPLE 2

Figure 13:
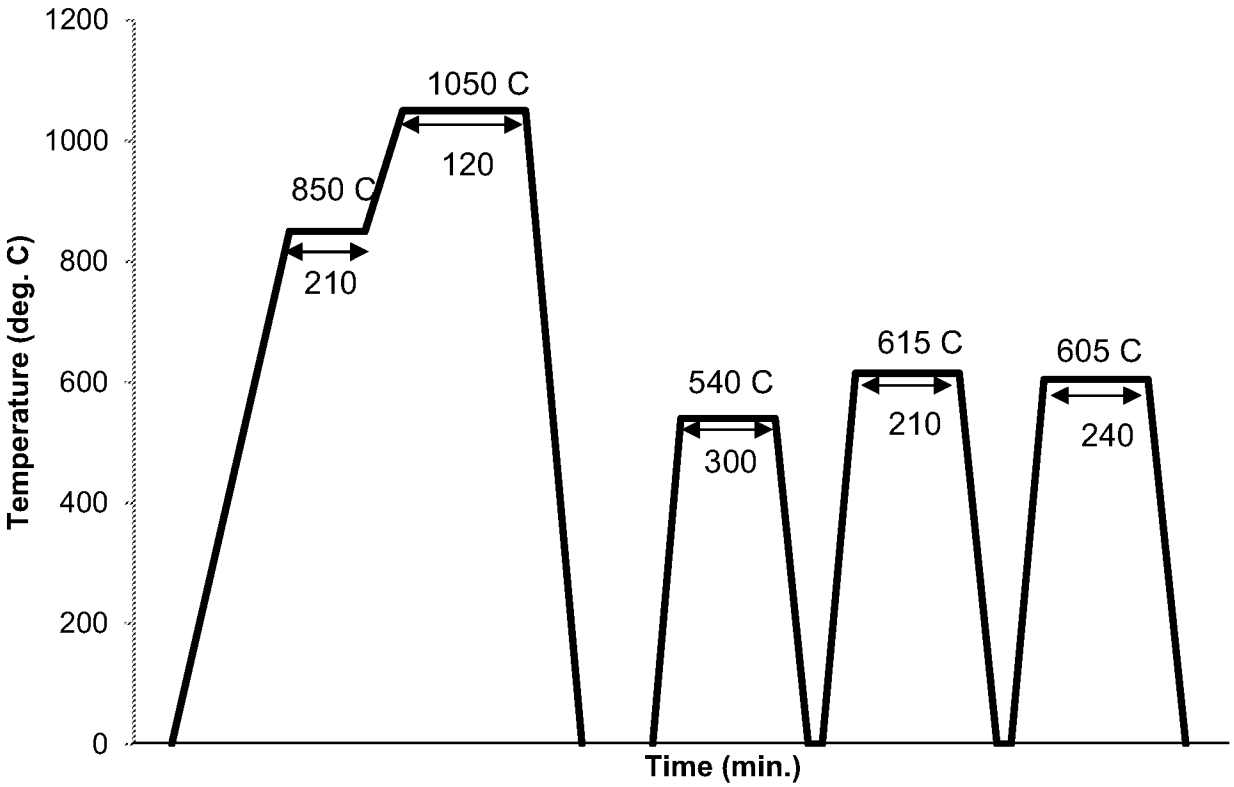
FIG. 13 shows a schematic graphical plot of an exemplary heat treatment for an exemplary tool steel, of which a portion of the shot sleeve of FIG. 2, and of which at least a portion of the dummy block of FIG. 12A, are fabricated.

In this example, a block-shaped sample of the steel composition shown in Table 1 was made, and was subjected to a heat treatment under vacuum comprising i) a hardening heat treatment, followed by ii) a tempering heat treatment. In this example, the hardening heat treatment comprised a hold temperature of 850° C. for 3.5 hours, followed by a hold temperature of 1050° C. for 2 hours. The tempering heat treatment comprised a series of three different hold temperatures, namely a hold temperature of 540° C. for 5 hours, a hold temperature of 615° C. for 3.5 hours, and a hold temperature of 605° C. for 4 hours, with the sample being cooled to room temperature prior to heating to each hold temperature. FIG. 13 shows a schematic graphical plot of the heat treatment. The heat treatment yielded a tempered sample.

The tempered sample was subjected to a nitriding surface treatment. In this example, the nitriding surface treatment comprised holding the tempered sample at a nitriding temperature of from about 515° C. to about 550° C. for 36 hours under a nitriding atmosphere. The nitriding surface treatment yielded a nitrided sample.

Samples of the nitrided sample were cut and mounted for metallographic imaging. The metallographic samples were ground and polished in accordance with ASTM E3-11, and were then etched with a 2% Nital solution in accordance with ASTM E407-07e1 to reveal microstructure.

FIGS. 14 and FIGS. 15A to 15C are optical microscopic images of the polished metallographic samples before and after etching, respectively. The iron nitride phase was observed along the grain boundaries of the etched sample.

The thickness of the nitride surface layer was measured by optical microscopy at 500× magnification. The average measured thickness of the nitride surface layer was 10.1 μm (see FIG. 15B).

Figure 15A:
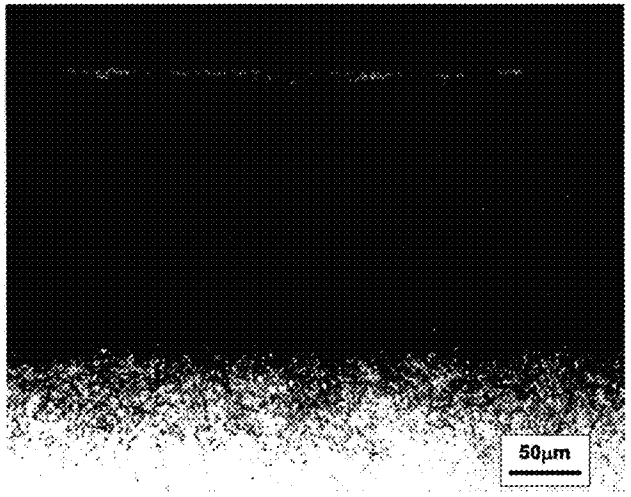
FIGS. 15A to 15C are optical microscopic images of the metallographic sample of FIG. 14, after etching.
Figure 15C:
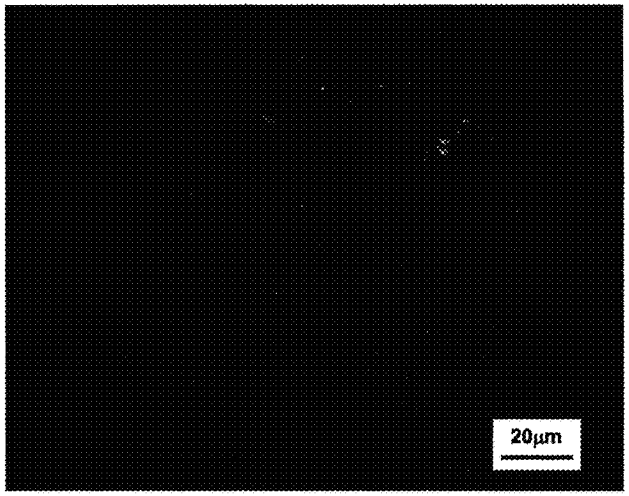
Figure 14:
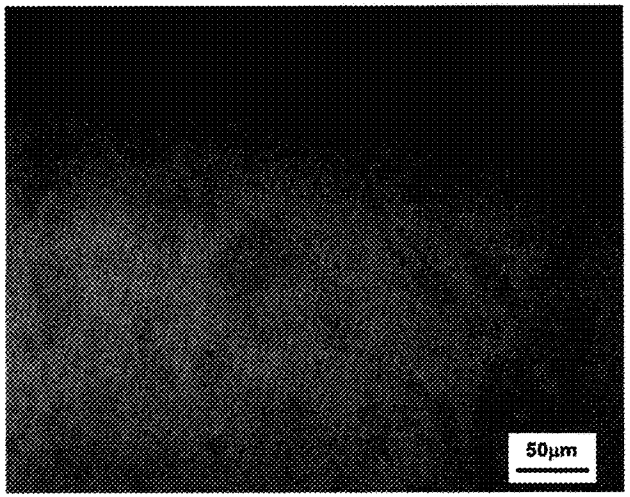
FIG. 14 is an optical microscopic image of a metallographic sample of the tool steel of FIG. 13.
Figure 15B:
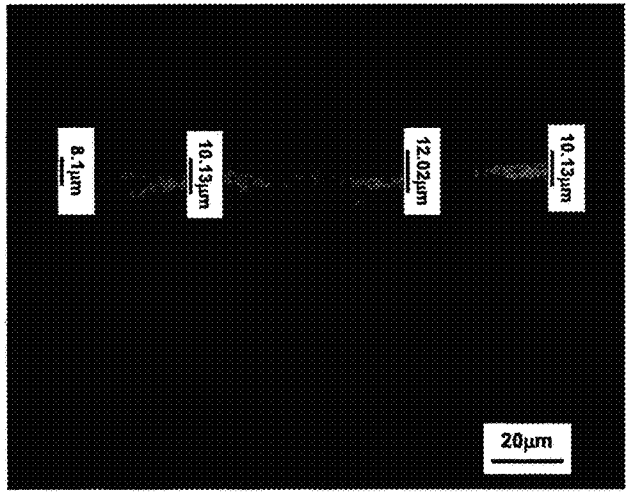

FIG. 15C shows a typical microstructure of the interior bulk of the sample (namely, at least 0.4 mm from the nitride surface layer). As may be seen, this microstructure consists mainly of tempered martensite. Ten (10) different locations of the interior bulk were observed, and no evidence of retained austenite was found.

EXAMPLE 3

In this example, hardness testing was conducted on the metallographic samples of Example 2. Vickers hardness was measured in accordance with ASTM E384-11e1, using a 100 gf load force (HV 0.1) and a 25 gf load force (HV 0.025). Vickers hardness measurements were converted to Rockwell C hardness values in accordance with ASTM E140-12b Conversion Table 1. Vickers hardness was measured at 30 μm intervals across a region beginning 0.03 mm from the sample surface (and therefore excluding the nitride surface layer) and extending into the interior bulk, as summarized in Table 2:

TABLE 2

| Distance from Sample Surface (mm) | Vickers Hardness (HV 0.1) | Rockwell C Hardness (HRC) |
|---|---|---|
| 0.03 | 840.9 | 65.2 |
| 0.06 | 926.1 | 67.6 |
| 0.09 | 980.8 | 68.6 |
| 0.12 | 906.8 | 67.1 |
| 0.15 | 792.1 | 63.7 |
| 0.18 | 738.1 | 61.6 |
| 0.21 | 612.4 | 55.9 |
| 0.24 | 582.0 | 54.2 |
| 0.27 | 521.8 | 50.5 |
| 0.3 | 500.4 | 49.1 |
| 0.33 | 473.0 | 47.1 |
| 0.36 | 468.2 | 46.7 |

Figure 16:
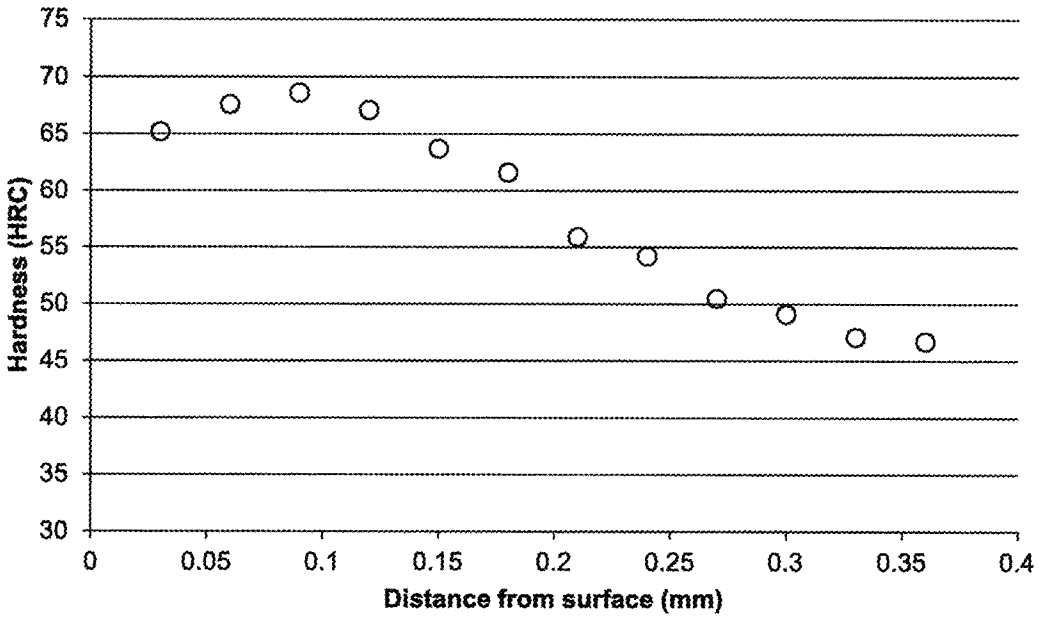
FIG. 16 is a graphical plot of hardness as a function of distance for the metallographic sample of FIG. 13.

FIG. 16 is a graphical plot of the hardness profile across the region summarized in Table 2.

Vickers hardness measurements within the interior bulk are summarized in Table 3:

TABLE 3

| Location within interior bulk | Vickers Hardness (HV 0.1) | Rockwell C Hardness (HRC) |
|---|---|---|
| #1 | 482.7 | 47.9 |
| #2 | 452.2 | 45.5 |
| #3 | 468.2 | 46.7 |
| Average | 467.7 | 46.7 |

Vickers hardness measurements within the nitride surface layer are summarized in Table 4:

TABLE 4

| Location within nitride surface layer | Vickers Hardness (HV 0.025) | Rockwell C Hardness (HRC) |
|---|---|---|
| #1 | 1131.8 | 70.6 |
| #2 | 1309.5 | 72.8 |
| #3 | 1080.5 | 70.0 |
| Average | 1173.9 | 71.1 |

EXAMPLE 4

In this example, tensile test specimens of two (2) different tool steels, namely (i) H13 grade steel and (ii) the tool steel composition shown in Table 1 and subjected to the heat treatment of Example 2, were made. The tensile test specimens were subjected to elevated temperature tension testing in accordance with ASTM E21-09. The testing was carried out at a temperature of 430° C. (806° F.), and used a soak time of 30 mins and a testing speed of 0.005 in/in/min, 0.05 in/min/in.

Figure 17A:
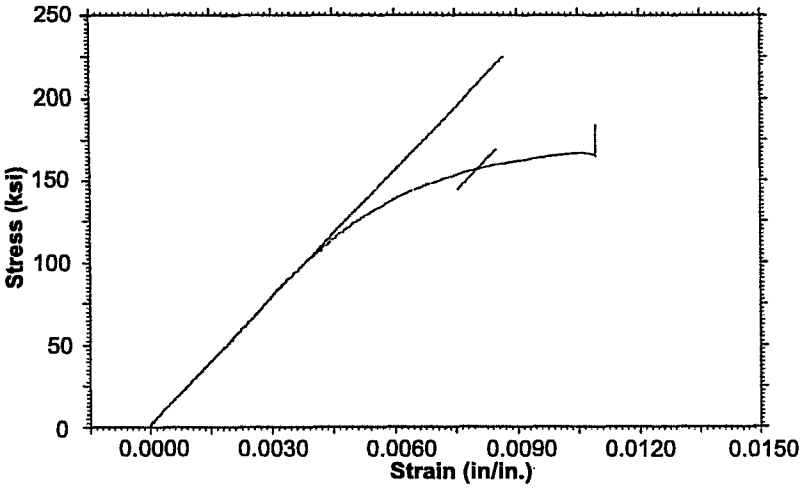
FIGS. 17A and 17B are graphical plots of tensile stress as a function of strain measured during elevated temperature tension testing of tensile specimens fabricated of H13 grade steel.
Figure 17B:
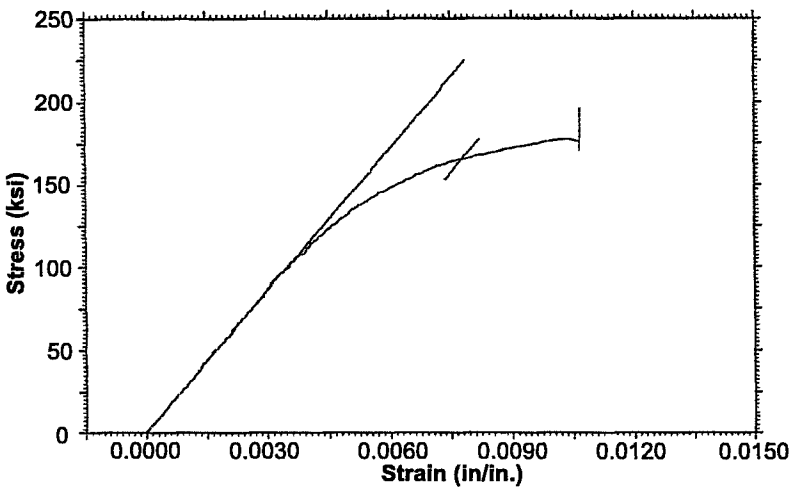
Figure 18A:
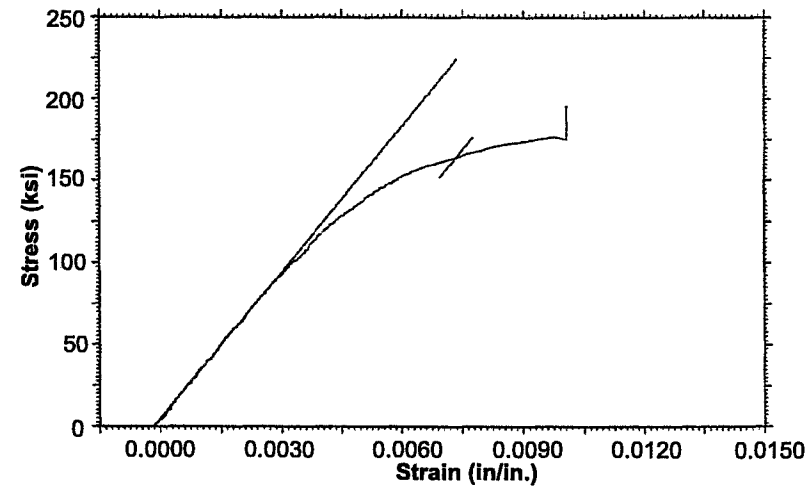
FIGS. 18A and 18B are graphical plots of tensile stress as a function of strain measured during elevated temperature tension testing of tensile specimens fabricated of the tool steel of FIG. 14.
Figure 18B:
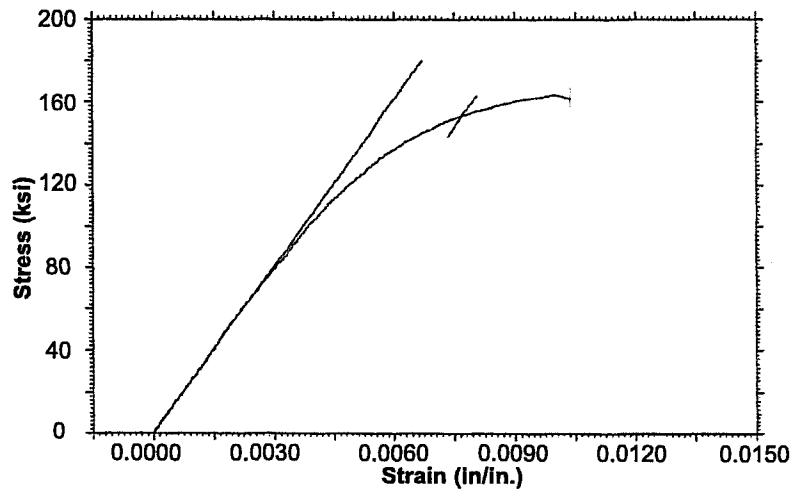

FIGS. 17A and 17B are graphical plots of tensile stress as a function of strain measured at the elevated temperature for the H13 grade steel specimens, and FIGS. 18A and 18B are graphical plots of tensile stress as a function of strain measured at the elevated temperature for the specimens fabricated of the tool steel composition shown in Table 1 and subjected to the heat treatment of Example 2. A portion of the elevated temperature tension test data is summarized in Table 5.

TABLE 5

| Sample | UTS (ksi) | 0.2% YS (ksi) | Elastic modulus (Msi) |
|---|---|---|---|
| H13 grade steel (specimen #1) | 184.6 | 156.8 | 25.8 |
| Tool Steel (specimen #1) | 196.3 | 165.5 | 28.5 |
| Tool Steel (specimen #2) | 196.0 | 164.3 | 29.8 |
| H13 grade steel (specimen #2) | 181.2 | 153.1 | 26.7 |

As can be seen, the tool steel has a higher ultimate tensile stress (UTS), a higher yield stress (YS), and a higher elastic modulus at the elevated temperature, as compared to H13 grade steel.

EXAMPLE 5

In this example, samples of the tool steel composition shown in Table 1 were subjected to tempering tests at various temperatures. Each sample was first hardened by subjecting it to a hardening heat treatment, which comprised a hold temperature of 850° C. for 3.5 hours, followed by a second hold temperature (referred to hereafter as "hardening temperature") for 2 hours, yielding a hardened sample. In this example, the hardening temperatures were 1050, 1070, 1090 and 1110° C. Each hardened sample was then subjected to a tempering heat treatment, comprising a series of two (2) identical hold temperatures (referred to hereafter as "tempering temperatures") for 2 hours each, with the sample being cooled to room temperature prior to heating to each tempering temperature. In this example, the tempering temperatures were 400, 500, 550, 575, 600, 625 and 650° C.

Vickers hardness was measured for each tempered sample (as well as for untempered samples) in accordance with ASTM E384-11e1, and Vickers hardness measurements were converted to Rockwell C hardness values in accordance with ASTM E140-12b Conversion Table 1.

Figure 19:
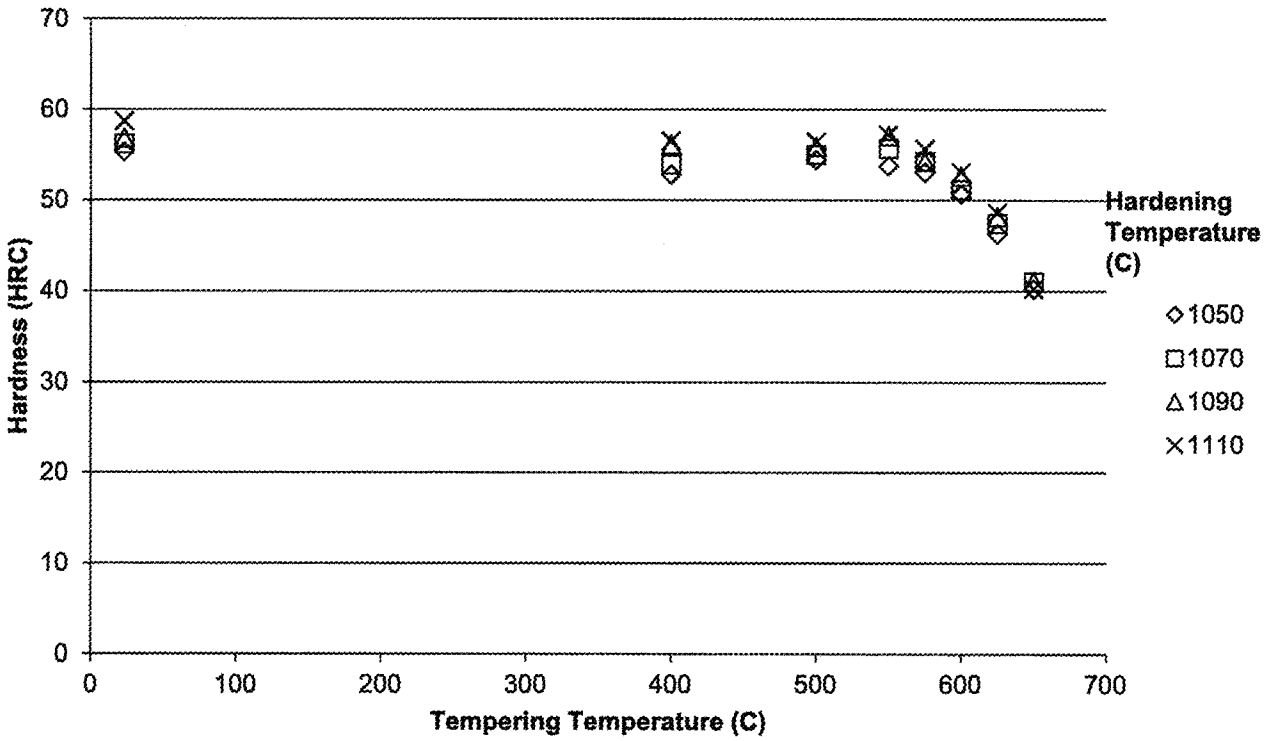
FIG. 19 is a graphical plot of hardness as a function of tempering temperature for samples fabricated of the tool steel of FIG. 13.

FIG. 19 is a graphical plot of Rockwell C hardness as a function of tempering temperature for the different hardening temperatures used. As can be seen, the highest hardness values for this tool steel were obtained using a tempering temperature of 550° C.

EXAMPLE 6

In this example, samples of two (2) different steels, namely (i) DIN 1.2367 grade steel and (ii) a tool steel composition similar to that shown in Table 1, were subjected to solidification testing to determine metal carbide concentration. The compositions of the steels are shown in Table 6:

| Element | DIN 1.2367 grade steel (Weight %) | Tool steel (Weight %) |
|---|---|---|
| C | 0.37 | 0.37 |
| Si | 0.40 | 0.40 |
| Mn | 0.40 | 0.40 |
| Cr | 5.00 | 5.00 |
| Mo | 3.00 | 3.85 |
| V | 0.60 | 0.90 |

As can be seen, the tool steel has higher Mo and V concentrations than DIN 1.2367 grade steel. Additionally, and as can be seen, the tool steel has C, Si, Mn, Cr, Mo and V concentrations that are commensurate with those of the tool steel composition shown in Table 1.

Figure 20A:
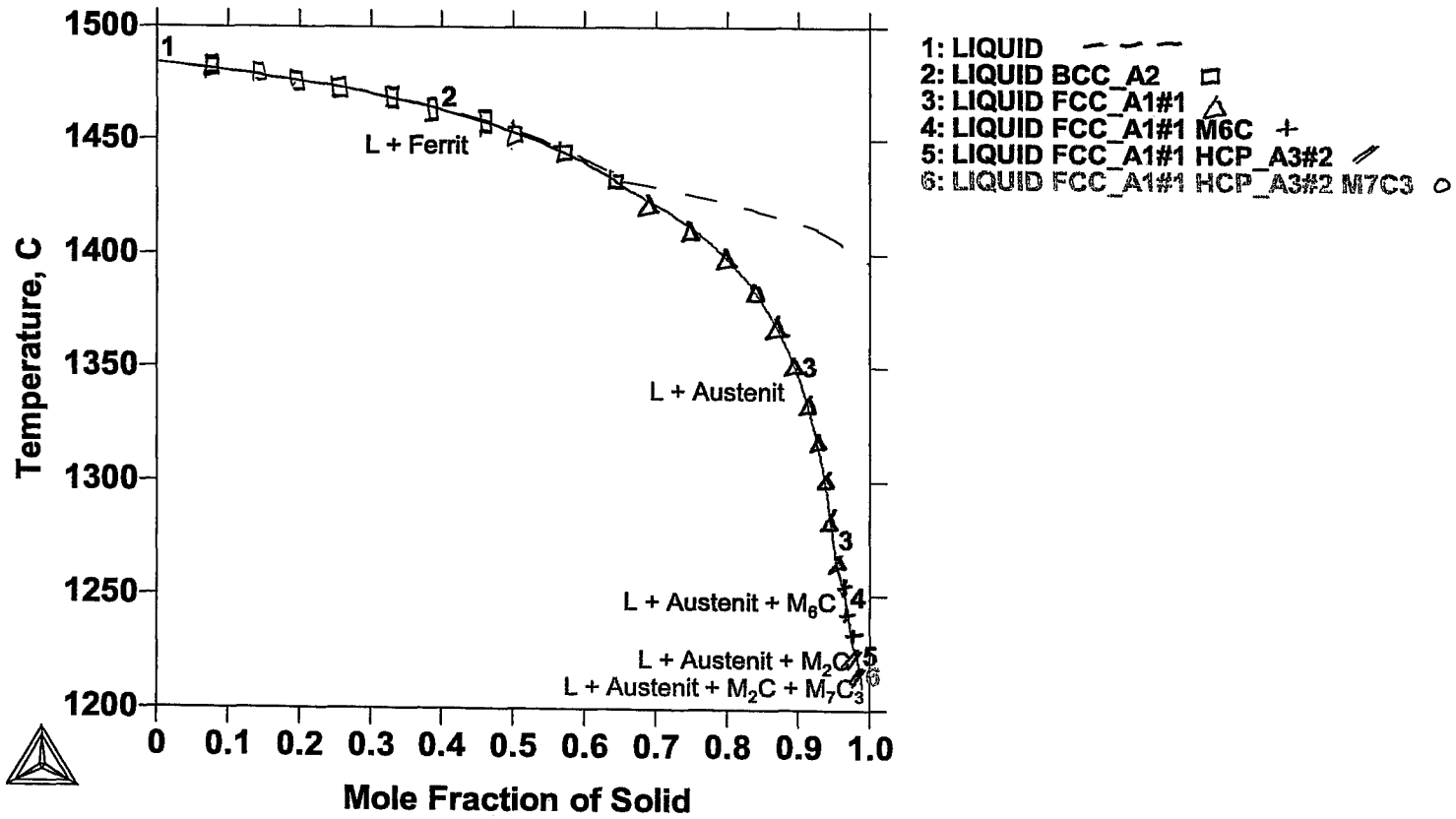
FIGS. 20A and 20B are graphical plots of solidification curves for DIN 1.2367 grade steel, and for another exemplary tool steel having a similar composition to the tool steel of FIG. 13, respectively.
Figure 20B:
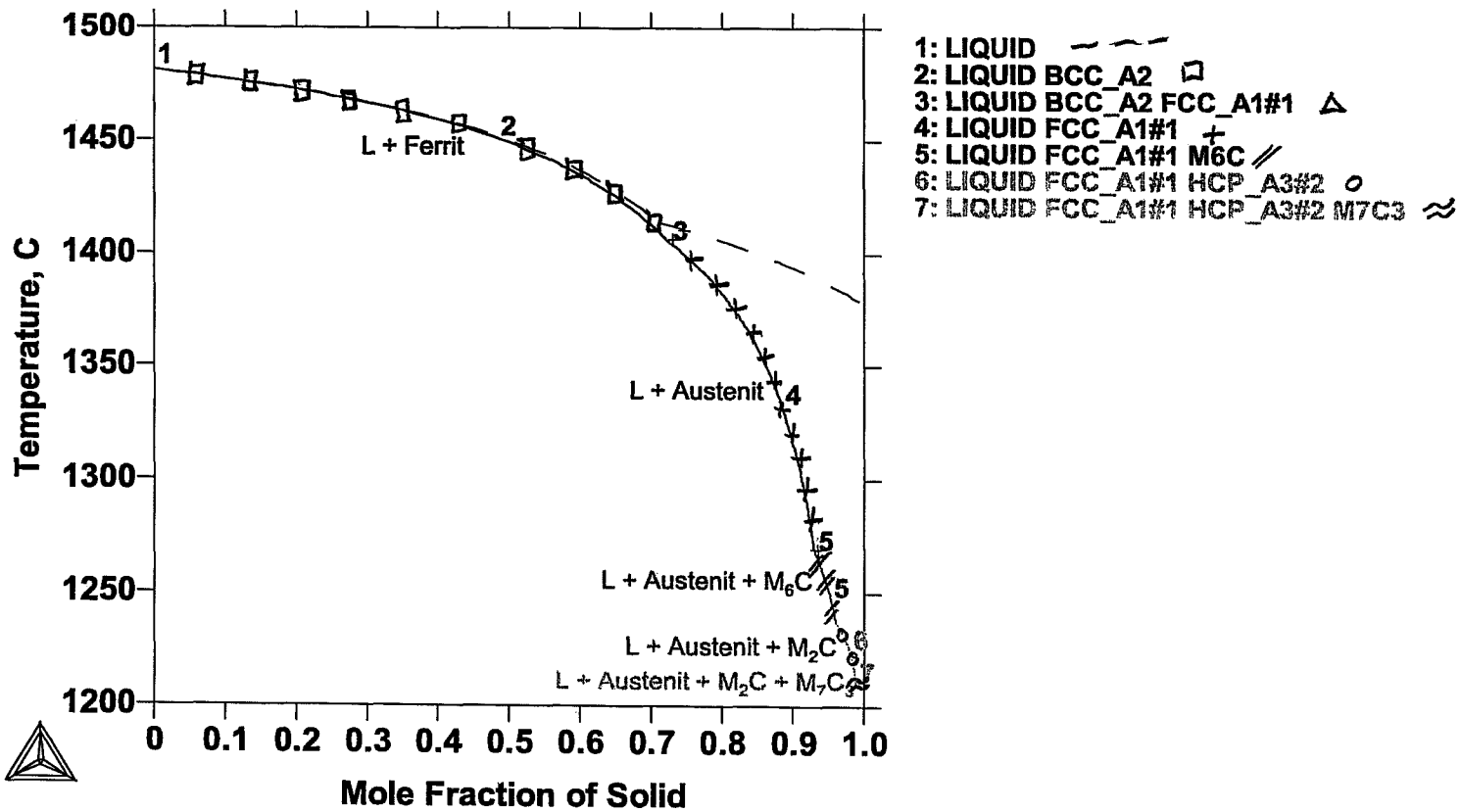

FIGS. 20A and 20B are graphical plots of solidification curves for the DIN 1.2367 grade steel sample and for the tool steel sample, respectively. According to Scheil-Gulliver analysis of the solidification curve data, the DIN 1.2367 grade steel sample yields 0.39 mol % of $M_6C$ carbides and 0.21 mol % of $M_2C$ carbides, while the tool steel sample yields 0.51 mol % of $M_6C$ carbides and 0.43 mol % of $M_2C$ carbides. As will be appreciated, the higher metal carbide concentrations in the tool steel sample are attributable to the higher Mo and V concentrations. As increased metal carbide concentrations result in increased wear resistance, the tool steel advantageously has a higher wear resistance than conventional tool steels, such as DIN 1.2367 grade steel.

Although embodiments have been described above with reference to the accompanying drawings, those of skill in the art will appreciate that variations and modifications may be made without departing from the scope thereof as defined by the appended claims.

What is claimed is:

1. A tool steel having a composition of, in weight percentage:
from 0.35% to 0.40% carbon (C);
from 0.32% to 0.50% silicon (Si);
from 4.80% to 5.50% chromium (Cr);
from 3.75% to 4.75% molybdenum (Mo);
from 0.80% to 1.00% vanadium (V);
from 0.09% to 0.14% tungsten (W);
from 0.06% to 0.12% nickel (Ni);
less than 0.005% sulfur (S); and
iron (Fe),
wherein the tool steel has an ultimate tensile stress (UTS) of 196.0 ksi at a temperature of 430° C., as measured in accordance with ASTM E21-09 standard, and
wherein the tool steel has a yield stress (0.2% YS) of 164.3 ksi at a temperature of 430° C., as measured in accordance with ASTM E21-09 standard.

2. The tool steel of claim 1, wherein the composition has, in weight percentage:
from 0.36% to 0.39% carbon (C).

3. The tool steel of claim 2, wherein the composition has, in weight percentage:
from 0.37% to 0.39% carbon (C).

4. The tool steel of claim 3, wherein the composition has, in weight percentage, 0.38% carbon (C).

5. The tool steel of claim 1, wherein the composition has, in weight percentage:
from 0.32% to 0.45% silicon (Si).

6. The tool steel of claim 5, wherein the composition has, in weight percentage:
from 0.32% to 0.40% silicon (Si).

7. The tool steel of claim 6, wherein the composition has, in weight percentage, 0.34% silicon (Si).

8. The tool steel of claim 1, wherein the composition has, in weight percentage:
from 5.01% to 5.10% chromium (Cr).

9. The tool steel of claim 8, wherein the composition has, in weight percentage:
from 5.01% to 5.05% chromium (Cr).

10. The tool steel of claim 9, wherein the composition has, in weight percentage, 5.03% chromium (Cr).

11. The tool steel of claim 1, wherein the composition has, in weight percentage:
from 3.80% to 4.50% molybdenum (Mo).

12. The tool steel of claim 11, wherein the composition has, in weight percentage:
from 3.85% to 4.25% molybdenum (Mo).

13. The tool steel of claim 12, wherein the composition has, in weight percentage, 4.18% molybdenum (Mo).

14. The tool steel of claim 1, wherein the composition has, in weight percentage:
from 0.85% to 0.98% vanadium (V).

15. The tool steel of claim 14, wherein the composition has, in weight percentage:
from 0.90% to 0.96% vanadium (V).

16. The tool steel of claim 15, wherein the composition has, in weight percentage, 0.94% vanadium (V).

17. A shot sleeve for a die-casting apparatus, the shot sleeve having a piston bore, the shot sleeve comprising:
an elongate body having an axial bore; and
a sleeve liner formed on a surface of the axial bore, the sleeve liner defining a surface of the piston bore,
at least one of the body and the sleeve liner being fabricated of the tool steel of claim 1.

18. A dummy block for a metal extrusion press comprising:
a generally cylindrical base having a forward surface and an outwardly extending circumferential flange;
an expandable collar coupled to the base, the collar having an inwardly extending circumferential rib abutting the circumferential flange;

a collar support coupled to the base and abutting the collar; and a moveable plunger coupled to the base and accommodated by the collar, the plunger having a rear surface configured to abut the forward surface of the base, at least one of the base, the collar, the collar support and the plunger being fabricated of the tool steel of claim 1.

19. A method of preparing the tool steel of claim 1, the method comprising:

subjecting a tool steel having a composition of, in weight percentage: from 0.35% to 0.40% carbon (C); from 0.32% to 0.50% silicon (Si); from 4.80% to 5.50% chromium (Cr); from 3.75% to 4.75% molybdenum (Mo); from 0.80% to 1.00% vanadium (V); from 0.09% to 0.14% tungsten (W); from 0.06% to 0.12% nickel (Ni); less than 0.005% sulfur (S); and iron (Fe), to a heat treatment, the heat treatment comprising:

a hardening heat treatment comprising: heating the tool steel having the composition to one or more temperatures from 850° C. to 1125° C. for a total time of from 1 hour to 25 hours; and after the hardening heat treatment, a tempering heat treatment comprising: heating the tool steel having the composition to one or more temperatures from 375° C. to 675° C. for a total time of from 1 hour to 25 hours.

20. The method of claim 19, wherein the hardening heat treatment comprises:

heating the tool steel having the composition to a first temperature of from 800° C. to 900° C., and holding the tool steel having the composition at the first temperature for at least 30 minutes; and heating the tool steel having the composition to a second temperature of from 950° C. to 1150° C., and holding the tool steel having the composition at the second temperature for at least 30 minutes.

21. The method of claim 19, wherein the tempering heat treatment comprises:

subjecting the tool steel having the composition to at least one tempering cycle comprising:

heating the tool steel having the composition to a temperature of from 400° C. to 600° C., and holding the tool steel having the composition at the temperature for at least 60 minutes.

* * * * *